US010344579B2

(12) United States Patent
Harding et al.

(10) Patent No.: US 10,344,579 B2
(45) Date of Patent: Jul. 9, 2019

(54) PROCESSES FOR PRODUCING HYDROCARBONS FROM A RESERVOIR

(71) Applicant: NEXEN ENERGY ULC, Calgary (CA)

(72) Inventors: Thomas Harding, Calgary (CA); Richard Kelso Kerr, Calgary (CA); Ann Chen Howe, Calgary (CA)

(73) Assignee: CNOOC PETROLEUM NORTH AMERICA ULC, Calgary (CA)

( * ) Notice: Subject to any disclaimer, the term of this patent is extended or adjusted under 35 U.S.C. 154(b) by 21 days.

(21) Appl. No.: 15/525,174

(22) PCT Filed: May 7, 2015

(86) PCT No.: PCT/CA2015/000299

§ 371 (c)(1),
(2) Date: May 8, 2017

(87) PCT Pub. No.: WO2016/070262

PCT Pub. Date: May 12, 2016

(65) Prior Publication Data

US 2017/0321528 A1 Nov. 9, 2017

(30) Foreign Application Priority Data

Nov. 6, 2014 (WO) ..... PCT/CA2014/000795

(51) Int. Cl.
*E21B 43/24* (2006.01)
*E21B 36/04* (2006.01)
(Continued)

(52) U.S. Cl.
CPC ..... *E21B 43/2406* (2013.01); *E21B 36/04* (2013.01); *E21B 43/2401* (2013.01);
(Continued)

(58) Field of Classification Search
CPC .. E21B 43/2406; E21B 36/04; E21B 43/2401; E21B 43/2408; E21B 47/065; E21B 47/00
(Continued)

(56) References Cited

U.S. PATENT DOCUMENTS 3,848,671 A * 11/1974 Kern ..... E21B 43/24 166/248
4,228,853 A 10/1980 Harvey
(Continued)

FOREIGN PATENT DOCUMENTS

CA 2052202 C 4/1992
CA 2304938 A1 * 2/2001 ..... C09K 8/592
(Continued)

OTHER PUBLICATIONS

Petroleum Society Canadian Institute of Mining, Metallurgy & Petroleum, "Thermal Solvent Reflux and Thermal Solvent Hybrid Experiments", J. Ivory, T. Frauenfeld, C. Jossy, paper 2007-067.

*Primary Examiner* — Angela M DiTrani Leff
(74) *Attorney, Agent, or Firm* — Norton Rose Fulbright Canada LLP

(57) ABSTRACT

There is provided a process for producing hydrocarbons from a reservoir. The process includes within the hydrocarbon reservoir, electrically heating a liquid heating fluid such that the liquid heating fluid is evaporated to produce a gaseous heating fluid, heating hydrocarbon material with the gaseous heating fluid such that the heated hydrocarbon material is mobilized and such that the gaseous heating fluid is condensed to produce a condensed heating fluid, and electrically heating at least a fraction of the condensed heating fluid such that the at least a condensed heating fluid fraction is re-evaporated, and while the evaporation, the condensing, and the re-evaporation are being effected, pro-
(Continued)

ducing a produced fluid including at least the mobilized hydrocarbon material.

17 Claims, 8 Drawing Sheets

(51) Int. Cl.
*E21B 47/06* (2012.01)
*E21B 47/00* (2012.01)

(52) U.S. Cl.
CPC ..... *E21B 43/2408* (2013.01); *E21B 47/065* (2013.01); *E21B 47/00* (2013.01)

(58) Field of Classification Search
USPC ..... 166/272.6
See application file for complete search history.

(56) References Cited

U.S. PATENT DOCUMENTS

| | | | | |
|---|---|---|---|---|
| 4,378,846 | A | 4/1983 | Brock | |
| 4,640,352 | A | 2/1987 | Vanmeurs et al. | |
| 4,640,353 | A | 2/1987 | Schuh | |
| 4,651,825 | A | 3/1987 | Wilson | |
| 4,694,907 | A | 9/1987 | Stahl et al. | |
| 5,517,593 | A | 5/1996 | Nenniger | |
| 7,243,721 | B2 | 7/2007 | Arnaud et al. | |
| 7,975,763 | B2 * | 7/2011 | Banerjee | E21B 43/2408 166/248 |
| 8,863,839 | B2 | 10/2014 | Kaminsky et al. | |
| 9,869,169 | B2 | 1/2018 | Frederick et al. | |
| 2003/0098149 | A1 | 5/2003 | Wellington et al. | |
| 2003/0131995 | A1 | 7/2003 | de Rouffignac et al. | |
| 2003/0136559 | A1 | 7/2003 | Wellington et al. | |
| 2003/0173081 | A1 | 9/2003 | Vinegar et al. | |
| 2003/0178191 | A1 | 9/2003 | Maher et al. | |
| 2003/0205378 | A1 | 11/2003 | Wellington et al. | |
| 2012/0118565 | A1 * | 5/2012 | Trautman | E21B 43/16 166/272.6 |
| 2014/0054028 | A1 * | 2/2014 | Little | E21B 43/24 166/248 |
| 2014/0246193 | A1 | 9/2014 | Wollen | |

FOREIGN PATENT DOCUMENTS

| | | | |
|---|---|---|---|
| CA | 2737083 | A1 | 3/2010 |
| CA | 2721991 | A1 | 5/2011 |
| CA | 2829009 | A1 | 4/2014 |
| CA | 2829033 | A1 | 4/2014 |
| CA | 2808723 | A1 | 9/2014 |
| CA | 2846924 | A1 | 9/2015 |
| CA | 2875687 | A1 | 9/2015 |
| CA | 2988164 | A1 | 9/2015 |
| CA | 2676086 | C | 11/2015 |
| CA | 2881763 | C | 12/2017 |
| CA | 2847141 | C | 4/2018 |
| WO | 2007050445 | A1 | 5/2007 |
| WO | 2014081328 | A1 | 5/2014 |

* cited by examiner

PROCESSES FOR PRODUCING HYDROCARBONS FROM A RESERVOIR

CROSS-REFERENCE TO RELATED APPLICATIONS

This application is a national phase application under 35 U.S.C. 371 of International Patent Application No. PCT/CA2015/000299 filed on May 7, 2015, and claims all benefit, including priority, of PCT patent application PCT/CA2014/000795, filed Nov. 6, 2014, and entitled "PROCESSES FOR PRODUCING HYDROCARBONS FROM A RESERVOIR," the entire contents of which are herein incorporated by this reference.

FIELD

The present disclosures relates to improvements in production of hydrocarbon material from hydrocarbon-bearing reservoirs.

BACKGROUND

Thermal enhanced oil recovery methods are used to recover bitumen and heavy oil from hydrocarbon reservoirs. Petroleum reservoirs contain solid matrix, oil and water and all thermal recovery processes used for heavy oil recovery employ heat to raise the temperature of the oils to reduce their viscosity. In the process, all of the materials present in the reservoir must be heated in order to achieve heating of the oil. In the present disclosure, the water present in the formation is used as the primary heat transfer medium, supplemented with a minimal amount of injected fluid. The most dominant of the thermal recovery methods is steam-assisted gravity drainage ("SAGD"). SAGD operations are impaired by energy losses and hydraulic pressure losses suffered by fluids being conducted through the injection and production wells. As well, SAGD operations are particularly susceptible to fluid incursions from active water zones, which may disrupt the SAGD process. The SAGD process also suffers from high capital and operating costs making SAGD project economics marginal and susceptible to changes in commodity price. SAGD involves the use of large amounts of water and consumes significant quantities of fuel for steam generation causing large carbon dioxide emissions.

SUMMARY

In one aspect, there is provided a process for producing hydrocarbons from a reservoir, including:

within the hydrocarbon reservoir, electrically heating a liquid heating fluid such that the liquid heating fluid is evaporated to produce a gaseous heating fluid;

heating hydrocarbon material with the gaseous heating fluid such that the heated hydrocarbon material is mobilized and such that the gaseous heating fluid is condensed to produce a condensed heating fluid;

electrically heating at least a fraction of the condensed heating fluid such that the at least a condensed heating fluid fraction is re-evaporated; and while the evaporation, the condensing, and the re-evaporation are being effected, producing a produced fluid including at least the mobilized hydrocarbon material.

In another aspect, there is provided a process for producing hydrocarbon material from an hydrocarbon reservoir comprising:

operating a first steam-assisted gravity drainage ("SAGD") system including a first SAGD well pair, wherein the first SAGD well pair includes a first SAGD injection well and a first SAGD production well, such that hydrocarbon material is produced from the first SAGD production well;

operating a second SAGD system including a second SAGD well pair, wherein the second SAGD well pair includes a second SAGD injection well and a second SAGD production well, such that hydrocarbon material is produced from the second SAGD production well; and after a first steam chamber has been created by operation of the first SAGD system and a second steam chamber has been created by operation of the second SAGD system, and respective hydrocarbon material production has been effected by each one of the operation of the first SAGD system and the operation of the second SAGD system, independently, such that a wedge zone has been formed within the hydrocarbon reservoir between the first and second steam chambers, operating an in-situ reflux process within the wedge zone for producing hydrocarbon material from the wedge zone.

In a further aspect, there is provided a process for producing hydrocarbon material from an hydrocarbon reservoir, including:

operating a first steam-assisted gravity drainage ("SAGD") system including a first SAGD well pair, wherein the first SAGD well pair includes a first SAGD injection well and a first SAGD production well, such that hydrocarbon material is produced from the first SAGD production well;

operating a second SAGD system including a second SAGD well pair, wherein the second SAGD well pair including a second SAGD injection well and a second SAGD production well, such that hydrocarbon material is produced from the second SAGD production well; and after respective hydrocarbon material production has been effected by each one of the operation of the first SAGD system and the operation of the second SAGD system, independently, operating an in-situ reflux process, wherein the operating of an in-situ reflux process includes:

within the hydrocarbon reservoir, electrically heating a liquid heating fluid such that the liquid heating fluid is evaporated to produce a gaseous heating fluid;

heating hydrocarbon material, within an intermediate hydrocarbon reservoir zone disposed between the first and second SAGD well pairs, with the gaseous heating fluid such that the heated hydrocarbon material is mobilized and such that the gaseous first heating fluid is condensed to produce a condensed heating fluid;

electrically heating at least a fraction of the condensed heating fluid such that the at least a condensed heating fluid fraction is re-evaporated; and while the evaporation, the condensing, and the re-evaporation is being effected, producing reservoir fluid, including at least a fraction of the mobilized hydrocarbon material, through an intermediate production well.

In one aspect, there is provided a process for producing hydrocarbon-comprising material from a hydrocarbon reservoir comprising:

(a) during a first time interval, while supplying a liquid heating fluid to the hydrocarbon reservoir through a well, electrically heating, within the well, with an electrical heater, a combined heating fluid including the supplied liquid heating fluid and a condensed heating fluid, such that the combined heating fluid is evaporated to produce a gaseous heating fluid that is conducted into the reservoir and then condensed upon heating of hydrocarbon material to produce the condensed heating fluid;

(b) suspending the supplying of the liquid heating fluid;

(c) after the suspending of the supplying of the liquid heating fluid, and during a second time interval, reducing the rate at which heat energy is being delivered by the electric heater such that the rate at which heat energy is being delivered by the electric heater is less than 50% of the rate at which heat energy is being delivered by the electric heater during the first time interval, and while the electric heater is delivering the heat energy at the reduced rate, collecting reservoir fluid within the well, and producing the collected reservoir fluid, wherein the collected reservoir fluid includes the heated hydrocarbon material that has become mobilized and drained into the well; and (d) suspending the producing.

In one aspect, there is provided a cyclic process for producing hydrocarbon-comprising material from a hydrocarbon reservoir comprising:

(a) during a first time interval, while supplying a liquid heating fluid to the hydrocarbon reservoir through a well, electrically heating, within the well, with an electrical heater, a combined heating fluid including the supplied liquid heating fluid and a condensed heating fluid, such that the combined heating fluid is evaporated to produce a gaseous heating fluid that is conducted into the reservoir and then condensed upon heating of hydrocarbon material to produce the condensed heating fluid;

(b) suspending the supplying of the liquid heating fluid;

(c) after the suspending of the supplying of the liquid heating fluid, and during a second time interval, reducing the rate at which heat energy is being delivered by the electric heater such that the rate at which heat energy is being delivered by the electric heater is less than 50% of the rate at which heat energy is being delivered by the electric heater during the first time interval, and while the electric heater is delivering the heat energy at the reduced rate, collecting reservoir fluid within the well, and producing the collected reservoir fluid, wherein the collected reservoir fluid includes the heated hydrocarbon material that has become mobilized and drained into the well; and (d) suspending the producing.

In one aspect, there is provided a process for producing hydrocarbon-comprising material from a hydrocarbon reservoir comprising:

(a) during a first time interval, while supplying a liquid heating fluid to the hydrocarbon reservoir through a well, electrically heating, within the well, a combined heating fluid including the supplied liquid heating fluid and a condensed heating fluid, such that the combined heating fluid is evaporated to produce a gaseous heating fluid that is conducted into the reservoir, and then condensed upon heating of hydrocarbon material to produce the condensed heating fluid;

(b) suspending the supplying of the liquid heating fluid;

(c) after the suspending of the supplying of the liquid heating fluid, during a second time interval, modulating the electrical heating such that the electrical heating of reservoir fluid that is being collected within the well is such that the temperature of the collected reservoir fluid is less than 350 degrees Celsius, and, while the modulated electrical heating of collected reservoir fluid is being effected, producing the collected reservoir fluid from the well; and (d) suspending the producing.

In one aspect, there is provided a cyclic process for producing hydrocarbon-comprising material from a hydrocarbon reservoir comprising:

(a) during a first time interval, while supplying a liquid heating fluid to the hydrocarbon reservoir through a well, electrically heating, within the well, a combined heating fluid including the supplied liquid heating fluid and a condensed heating fluid, such that the combined heating fluid is evaporated to produce a gaseous heating fluid that is conducted into the reservoir, and then condensed upon heating of hydrocarbon material to produce the condensed heating fluid;

(b) suspending the supplying of the liquid heating fluid;

(c) after the suspending of the supplying of the liquid heating fluid, during a second time interval, modulating the electrical heating such that the electrical heating of reservoir fluid that is being collected within the well is such that the temperature of the collected reservoir fluid is less than 350 degrees Celsius, and, while the modulated electrical heating of collected reservoir fluid is being effected, producing the collected reservoir fluid from the well; and (d) suspending the producing.

In one aspect, there is provided a process for producing hydrocarbon-comprising material from a hydrocarbon reservoir comprising:

during a first time interval:

while supplying a liquid heating fluid to the hydrocarbon reservoir through a non-production well that is disposed within the hydrocarbon reservoir, electrically heating, within the non-production well, with a first electrical heater, a combined heating fluid including the supplied liquid heating fluid and a condensed heating fluid, such that the combined heating fluid is evaporated to produce a gaseous heating fluid that is conducted into the reservoir and then condensed upon heating of hydrocarbon material to produce the condensed heating fluid; and with a second electrical heater disposed within a production well that is disposed below the non-production well and within the hydrocarbon reservoir, electrically heating the hydrocarbon reservoir;

and after the first time interval, and during a second time interval, while either one of:

(a) the second electrical heater is delivering heat energy at a rate that is less than 50% of the rate at which heat energy is being delivered by the second electrical heater during the first time interval; or (b) the electrical heating being effected by the second electrical heater has become suspended;

and while continuing to effect the electrical heating with the first electric heater:

supplying a liquid heating fluid to the hydrocarbon reservoir through the non-production well, such that a combined heating fluid, including the supplied liquid heating fluid and a condensed heating fluid, is evaporated to produce a gaseous heating fluid that is conducted into the hydrocarbon reservoir and then condensed upon heating of hydrocarbon material to produce the condensed heating fluid; and producing, via a production well, reservoir fluid that has collected within the production well, wherein the collected reservoir fluid includes hydrocarbon material that has been mobilized by the gaseous heating fluid.

In one aspect, there is provided a process for producing hydrocarbon-comprising material from a hydrocarbon reservoir comprising:

while supplying a liquid heating fluid to the hydrocarbon reservoir through a non-production well that is disposed within the hydrocarbon reservoir, electrically heating, within the non-production well, with a first electrical heater, a combined heating fluid including the supplied liquid heating fluid and a condensed heating fluid, such that the combined heating fluid is evaporated to produce a gaseous heating fluid that is conducted into the reservoir and then condensed upon heating of hydrocarbon material to produce the condensed heating fluid; and producing, via a production well, reservoir fluid that has collected within the production well, wherein the collected reservoir fluid includes hydrocarbon material that has been mobilized in response to heating by the gaseous heating fluid.

BRIEF DESCRIPTION OF THE DRAWINGS

In the drawings, embodiments of the invention are illustrated by way of example. It is to be expressly understood that the description and drawings are only for the purpose of illustration and as an aid to understanding, and are not intended as a definition of the limits of the invention.

Embodiments will now be described, by way of example only, with reference to the attached figures, wherein.

DETAILED DESCRIPTION

Figure 1:
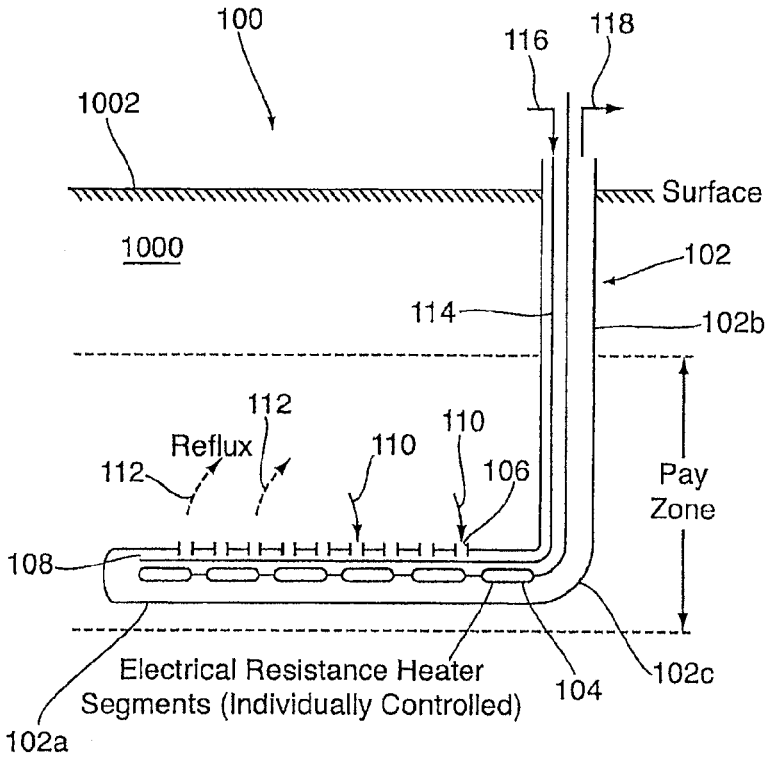
FIG. 1 is a schematic illustration of an embodiment of a system, with a single well, used to implement the in-situ reflux process.

There is provided a process for producing hydrocarbon material from a hydrocarbon reservoir. Hydrocarbon material is a material that consists of a least one hydrocarbon compound.

In some embodiments, for example, the hydrocarbon material being produced includes, or is substantially, a liquid hydrocarbon material. In some embodiments, for example, the hydrocarbon material includes bitumen. In some of these embodiments, for example, the bitumen is a liquid hydrocarbon material with an API gravity less than, or equal to, 10, and with an in situ viscosity of greater than 10,000 centipoise. In some embodiments, for example, the hydrocarbon material includes heavy oil.

In some embodiments, for example, the hydrocarbon reservoir is an oil sands reservoir. In some embodiments, for example, the hydrocarbon reservoir is a heavy oil reservoir. In some embodiments, for example, the hydrocarbon reservoir is disposed subsea.

In one aspect, the process includes:

within the hydrocarbon reservoir, electrically heating a liquid heating fluid such that the liquid heating fluid is evaporated to produce a gaseous heating fluid;

heating hydrocarbon material with the gaseous heating fluid such that the heated hydrocarbon material is mobilized and such that the gaseous heating fluid is condensed to produce a condensed heating fluid;

electrically heating at least a fraction of the condensed heating fluid such that the at least a condensed heating fluid fraction is re-evaporated; and while the evaporation, the condensing, and the re-evaporation are being effected, producing a produced fluid including at least the mobilized hydrocarbon material.

For purposes of enabling ease of reference herein, the above-described process, or any one of the embodiments described below, may be referred to as an "in-situ reflux process".

In some embodiments, for example, the produced fluid may also include some heating fluid.

In some embodiments, for example, a reflux is effected. The reflux includes the evaporation, the condensing and the re-evaporation. While the reflux is being effected, reservoir fluid, including at least a fraction of the mobilized hydrocarbon material, is produced. The refluxing fluid is comprised mainly of reservoir connate water supplemented by additional water or other fluids injected into the reservoir.

By refluxing the heating fluid within the reservoir, heat losses are avoided, when compared to conducting a heating fluid, such as steam, from the surface and into the reservoir, such as during a steam-assisted gravity drainage ("SAGD) operation. Heat losses are attributable to the production of the condensed heating fluid (i.e. steam condensate) along with the heated and mobilized bitumen through the production well to the surface. The steam condensate is at or near saturated steam temperature as it is produced into the well, and heat losses occur as the produced fluid are conducted from the reservoir to the surface facilities. In the process of separating the oil from the water at the surface, additional heat is lost. In many SAGD operations, the produced water is further cooled to allow for treatment to render it suitable for recycling as boiler feedwater. Thus, if the water is "refluxed" within the reservoir, instead of being produced, the heat losses associated with the production and recycling of produced water are avoided.

In some embodiments, for example, the heating fluid, in its liquid state, may include formation water that is resident within the hydrocarbon reservoir, or may include heating fluid (for example, water) that is injected into the hydrocarbon reservoir and supplied from above the surface, or may include both of the formation water and the injected heating fluid.

In those embodiments where at least a fraction of the liquid heating fluid is being supplied from above the surface, in some of these embodiments, for example, the ratio of the volumetric rate at which the supplied liquid heating fluid is being supplied to the rate at which heat energy is being delivered by the electric heater is less than 25 cubic meters per day per megawatt, such as, for example, less than 10 cubic meters per day per megawatt.

In some embodiments, for example, the heating fluid includes water, such that, upon evaporation, steam is produced. The steam is conducted to the hydrocarbon material within the reservoir, and heats the hydrocarbon material, thereby effecting mobilization of the hydrocarbon material, while also effecting the condensation of the steam. In some embodiments, for example, at least some of the condensed steam then drains into a collection reservoir, where it is re-evaporated by an electric heater disposed within the collection reservoir.

In some embodiments, for example, the heating fluid may include any combination of an anti-foaming chemical, a corrosion inhibitor, a scale inhibitor, and solvent material that is soluble within the hydrocarbon material. In some embodiments, for example, the solvent material includes at least one hydrocarbon compound, wherein the at least one hydrocarbon compound includes a total number of carbon atoms of between three (3) and ten (10), such as between five (5) and seven (7).

For oil sands formations, and where the heating fluid, in the evaporated state, is steam, or is substantially steam, the cycle of evaporation, condensing and re-evaporation results in the creation of a steam chamber.

In some embodiments, for example, at least a fraction of the reflux is effected by an electric heater that is disposed within the hydrocarbon reservoir. In some embodiments, for example, electric heater includes an electrically resistive heater. In some embodiments, for example, the term "electric heater" covers heaters that effect electromagnetic heating.

In some embodiments, for example, the electric heater is disposed in indirect heat transfer communication with at least a fraction of the condensed heating fluid.

In some embodiments, for example, the electric heater is disposed within a collection reservoir, and the collection reservoir receives reservoir fluid from the hydrocarbon reservoir. The reservoir fluid includes the mobilized hydrocarbon material and condensed heating fluid. In some embodiments, for example, the collected reservoir fluid is free, or substantially free, of heating fluid. In this respect, the electrical heating by the electric heater is such that the collected reservoir fluid is free, or substantially free, of heating fluid. In some embodiments, for example, the collected reservoir fluid consists of, or substantially consists of, the mobilized hydrocarbon material. In this respect, the electrical heating by the electric heater is such that the collected reservoir fluid the collected reservoir fluid consists of, or substantially consists of, the mobilized hydrocarbon material. The collected reservoir fluid, consisting of, or substantially consisting of, the mobilized hydrocarbon material, is disposed in heat transfer fluid communication with the condensed heating fluid that is disposed externally of the collection reservoir. In this respect, upon heating by the electric heater, the collected reservoir fluid concomitantly effects the transfer of such heat imparted by the electric heater to the condensed heating fluid, thereby effecting evaporation of the condensed heating fluid. In some of these embodiments, for example, the heating of the collected reservoir fluid, consisting of, or substantially consisting of, the mobilized hydrocarbon material (and, in some embodiments, for example, being free, or substantially free of heating fluid), is such that the collected reservoir fluid is disposed at a temperature of less than 350 degrees Celsius, such as, for example, less than 300 degrees Celsius, such as, for example, less than 275 degrees Celsius, such as, for example less than 250 degrees Celsius.

In some embodiments, for example, the in-situ reflux is effected within a hydrocarbon reservoir that is disposed below a thin cap rock. In some embodiments, for example, the thin cap rock is a cap rock having a minimum thickness of less than two (2) meters, such as, for example, less than one (1) meter. In some embodiments, the subterranean formation extending between the hydrocarbon reservoir and the surface (of the earth) is permeable (i.e. there is no cap rock between the hydrocarbon reservoir and the surface, or the cap rock has a permeability of greater than 0.1 millidarcy).

Referring to FIG. 1, in some embodiments, for example, the in-situ reflux is effected with a single well 102. In this respect, a system 100 is provided for effecting in-situ reflux, and includes the well 102 which is used for both production of the produced fluid as well as for effecting the entirety of the reflux of the heating fluid that is effecting mobilization of the produced hydrocarbon material 118 (i.e. a second well is not being used to contain an electric heater to effect refluxing).

The produced fluid is produced through the production well 102. In some embodiments, for example, production is effected by artificial lift, such as by a downhole pump (such as, for example, an electric submersible pump) and/or by gas lift.

The production well 102 extends into the hydrocarbon reservoir 1000 from the surface. The production well 102 includes a collection reservoir 108 for collecting reservoir fluids. The reservoir fluids include mobilized hydrocarbon material and condensed heating fluid. In some embodiments, for example, the reservoir fluid being collected within the production well is free, or substantially free, of heating fluid. In some embodiments, for example, the reservoir fluid being collected within the production well consists of, or substantially consists of, mobilized hydrocarbon material Such collected reservoir fluid 110 may be in heat transfer communication with the condensed heating fluid, such as, for example, condensed heating fluid that is disposed externally of the production well 102. In some embodiments, for example, the collected reservoir fluid 110 may include the mobilized hydrocarbon material and condensed heating fluid.

An electric heater 104 is disposed within the production well 102 and, more specifically, within the collection reservoir 108 of the production well 102. The collection reservoir includes reservoir fluid that has collected therein. As mentioned above, the reservoir fluid includes mobilized hydrocarbon material, and may also include condensed heating fluid.

The electric heater 104 is configured for effecting heating of the collected reservoir fluid 110. In some embodiments, for example, the electric heater 104 is disposed in direct heat transfer communication with the collected reservoir fluid 110. Heating of any condensed heating fluid, whether disposed as part of the collected reservoir fluid 110, or disposed in heat transfer communication with the collected reservoir fluid 110, externally of the production well 102, is, therefore, effected by the electric heater 104, when the electric heater is heating the collected reservoir fluid 110. In some embodiments, for example, the electrical heating by the electric heater 104 is such that the collected reservoir fluid consists is free, or substantially free, of heating fluid. In some embodiments, for example, the electrical heating by the electric heater is such that the collected reservoir fluid consists of, or substantially consists of, the mobilized hydrocarbon material, and, in this respect, is free, or substantially free, of heating fluid.

Figure 8:
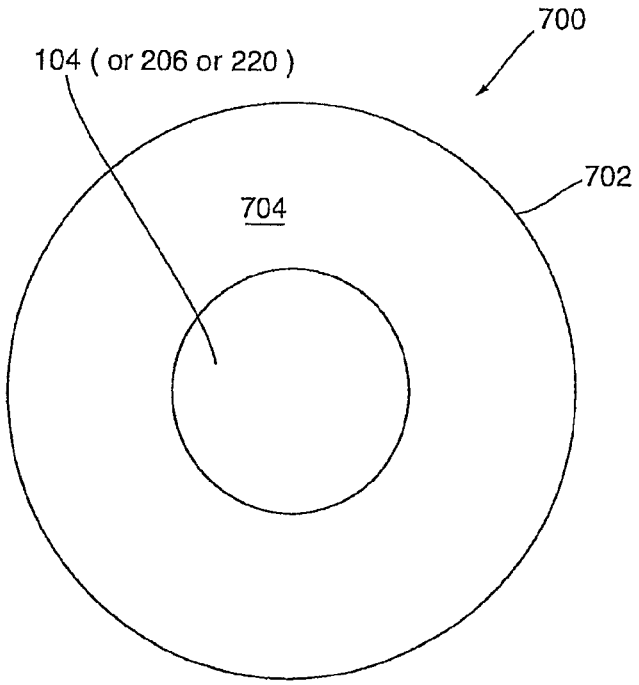
FIG. 8 is a sectional elevation view of a heating assembly of an embodiment of a system used to implement the in-situ reflux process.

Referring to FIG. 8, in some embodiments, for example, the electric heater 104 is part of a heating assembly 700, such that the electric heater is in indirect heat transfer communication with the reservoir fluid via a liquid heat transfer medium 704. An example of a suitable liquid heat transfer medium 704 is glycerin. In this respect, a heating assembly 700 is provided, and includes a housing 702, the electric heater, and the liquid heat transfer medium 704. The electric heater is disposed within a housing 702, with the space between the electric heater and the housing 702 being occupied with the liquid heat transfer medium 704. The liquid heat transfer medium 704 has a higher boiling point than that of the heating fluid at the pressure of the hydrocarbon reservoir portion from which the mobilized hydrocarbon material is being produced, such as by at least 10 degrees Celsius, such as, for example, by at least 20 degrees Celsius, such as, for example, by at least 50 degrees Celsius, such as, for example, by at least 100 degrees Celsius. The collection reservoir 108 is defined by a space within the production well 102, between the housing 702 and the wellbore string (such as, for example, casing) of the production well. Because the heater assembly is disposed within the collection reservoir, the liquid heat transfer medium 704 is disposed in heat transfer communication with the collected reservoir fluid, through the wall of the housing 702. In this respect, heat is transferred from the electric heater to the collected reservoir fluid via the liquid heat transfer medium 704 and through the wall of the housing 702. By virtue of this configuration, any evaporated heating fluid may become disposed at a relatively higher temperature, owing to the fact that the liquid heat transfer medium 704 can be heated to higher temperatures by the electric heater, and transfer this higher quality heat to the reservoir fluids (and, therefore, to the condensed heating fluid), versus direct heating of the reservoir fluids by the electric heater (without any intervening liquid heat transfer medium 704). This also facilitates production of a "drier" hydrocarbon material.

In some embodiments, for example, the electric heater 104 is disposed within a laterally extending section 102*a* of the production well 102, that extends from a vertically extending section 102*b*, at the heel 102*c* of the production well 102. In some embodiments, for example, the laterally extending section 102*a* is disposed along a horizontal, or substantially horizontal, axis.

In some embodiments, for example, the electric heater 104 includes a plurality of heater segments, and each one of the heater segments may be controllable independently from the other heater segments in terms of the rate of energy being produced. By providing a plurality of heater segments that are independently controllable, improved control of heating fluid conformance is made possible.

In some embodiments, for example, the electrical heating provides for more uniform heating of the hydrocarbon reservoir versus heating of the hydrocarbon reservoir with steam.

In some embodiments, for example, the electrical heating of the collected reservoir fluid 110 is such that the temperature of the collected reservoir fluid is greater than or equal to at least the boiling point of the liquid heating fluid at the pressure of the hydrocarbon reservoir portion from which the mobilized hydrocarbon material is being produced. In this respect, both of (i) evaporation of the heating fluid that is disposed in heat transfer communication with the collected reservoir fluid, but externally of the collection reservoir 108, and (ii) evaporation of any heating fluid that is present within the collected reservoir fluid, is promoted, so as to return the heating fluid to the reservoir for effecting mobilization of the hydrocarbon material within the reservoir 1000, and thereby contribute to the refluxing. As well, by promoting the evaporation, the produced fluid 118 that is being produced contains less heating fluid, thereby reducing energy requirements to transport the produced fluid to the surface 1002 (as there is less fluid volume to produce), and also reducing demands on separation processes for removal of heating fluid from the produced fluids.

In some embodiments, for example, the electrical heating of the collected reservoir fluid 110 is effected in response to sensing of a temperature, of the collected reservoir fluid, that is at or below a predetermined temperature that is based upon the boiling point of the liquid heating fluid at the pressure of the hydrocarbon reservoir portion from which the mobilized hydrocarbon material is being produced. In some embodiments, prior to the electrical heating of the collected reservoir fluid, a temperature of the collected reservoir fluid is sensed that is at or below a predetermined temperature that is based upon the boiling point of the liquid heating fluid at the pressure of the hydrocarbon reservoir portion from which the mobilized hydrocarbon material is being produced. In some embodiments, for example, the predetermined temperature is at or above the boiling point of the liquid heating fluid at the pressure of the hydrocarbon reservoir portion from which the mobilized hydrocarbon material is being produced. The purpose of having the predetermined temperature being at the boiling point of the liquid heating fluid at the pressure of the hydrocarbon reservoir portion from which the mobilized hydrocarbon material is being produced, is for evaporating liquid heating fluid that has collected within the well. Liquid heating fluid that has collected within the well would be disposed at or below the boiling point of the liquid heating fluid at the pressure of the hydrocarbon reservoir portion from which the mobilized hydrocarbon material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon material is being produced, the intention is to vaporize the liquid heating fluid that has collected within the well as part of the collected reservoir fluid. In some embodiments, for example, it may be intended to vaporize the heating fluid that is disposed externally of the well 102, in which case the predetermined temperature may be above the boiling point of the liquid heating fluid at the pressure of the hydrocarbon reservoir portion from which the mobilized hydrocarbon material is being produced, for purposes of precluding collection of the heating fluid within the well 102.

In some embodiments, for example, the production well 102 includes the heel 102*c*. In this respect, the electrical heating of the collected reservoir fluid by the electric heater 104 is such that the temperature of the collected reservoir fluid, disposed at the heel 102*c* of the production well 102, is greater than or equal to the boiling point of the liquid heating fluid at the pressure of the hydrocarbon reservoir portion from which the mobilized hydrocarbon material is being produced. Similar to the above, both of (i) evaporation of the heating fluid that is disposed in heat transfer communication with the collected reservoir fluid, but externally of the collection reservoir, and (ii) evaporation of any heating fluid that is present within the collected reservoir fluid, is promoted, so as to return the heating fluid to the reservoir for effecting mobilization of the hydrocarbon material within the reservoir, and thereby contribute to the refluxing. As well, by promoting the evaporation, the produced fluid that is being produced contains less heating fluid, thereby reducing energy requirements to transport the produced fluid to the surface (as there is less fluid volume to produce), and also reducing demands on separation processes for removal of heating fluid from the produced fluids.

In some embodiments, for example, the electrical heating of the collected reservoir fluid 110 by the electric heater 104 is effected in response to sensing of a temperature, of the collected reservoir fluid 110 disposed at the heel 102*c* of the production well 102, that is at or below a predetermined temperature that is based upon the boiling point of the liquid heating fluid at the pressure of the hydrocarbon reservoir portion from which the mobilized hydrocarbon material is being produced. In some embodiments, for example, prior to the electrical heating of the collected reservoir fluid 110 by the electric heater 104, a temperature, of the collected reservoir fluid that is disposed at the heel 102*c* of the production well 102, is sensed that is at or below a predetermined temperature that is based upon the boiling point of the liquid heating fluid at the pressure of the hydrocarbon reservoir portion from which the mobilized hydrocarbon material is being produced. In some embodiments, for example, the predetermined temperature is at or above the boiling point of the liquid heating fluid at the pressure of the hydrocarbon reservoir portion from which the mobilized hydrocarbon material is being produced. The purpose of having the predetermined temperature being at the boiling point of the liquid heating fluid at the pressure of the hydrocarbon reservoir portion from which the mobilized hydrocarbon material is being produced, is for evaporating liquid heating fluid that has collected within the well. Liquid heating fluid that has collected within the well would be disposed at or below the boiling point of the liquid heating fluid at the pressure of the hydrocarbon reservoir portion from which the mobilized hydrocarbon material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon material is being produced, the intention is to vaporize the liquid heating fluid that has collected within the well as part of the collected reservoir fluid. In some embodiments, for example, it may be intended to vaporize the heating fluid that is disposed externally of the well, in which case the predetermined temperature may be above the boiling point of the liquid heating fluid at the pressure of the hydrocarbon reservoir portion from which the mobilized hydrocarbon material is being produced, for purposes of precluding collection of the heating fluid within the well.

In some embodiments, for example, during a first time interval, the collected reservoir fluid 110, within the well 102, is not being produced (such as, for example, when the production of the collected reservoir fluid is suspended), liquid heating fluid is being supplied to the hydrocarbon reservoir via the well 102, and the electrical heating is such that the liquid heating fluid is evaporated and such that the hydrocarbon reservoir surrounding the well 102 becomes disposed above a predetermined temperature that is above the boiling point of the liquid heating fluid at the pressure of the hydrocarbon reservoir portion from which the mobilized hydrocarbon material is being produced (such as, for example, above 350 degrees Celsius). Both of the supplying of the liquid heating fluid and the electrical heating is then suspended. Subsequently, during a second time interval, and while the rate at which heat energy is being delivered by the electric heater is less than 50% of the rate at which heat energy is being delivered by the electric heater during the first time interval, the collected reservoir fluid 110 may be produced. In some of these embodiments, for example, during the second time interval, the rate at which heat energy is being delivered by the electric heater is less than 25% of the rate at which heat energy is being delivered by the electric heater during the first time interval. In some of these embodiments, for example, during the second time interval, the electrical heating by the electrical heater is suspended.

During the first time interval, the electrical heating is such that the hydrocarbon reservoir surrounding the well 102 becomes dry, or substantially dry, in that any heating fluid within this portion of the hydrocarbon reservoir, has become evaporated, and is being applied to effect heating and mobilization of hydrocarbon material within the reservoir. Further, in some embodiments, for example, the electrical heating during the first time interval may be sufficient to effect heating of liquid heating fluid being supplied to the hydrocarbon reservoir, via the well 102, to relatively high temperatures, including those which would otherwise promote coking of hydrocarbon material that is collected within collection reservoir of the well 102, so long as collection of the mobilized hydrocarbon material within the collection reservoir is avoided. During the first time interval, draining of the mobilized hydrocarbon material into the collection reservoir may be precluded by the high pressure conditions existing at the collection reservoir owing to the evaporation of the liquid heating fluid. During the second time interval, the mobilized hydrocarbon material is draining and collecting within the well 102, and is then subsequently produced. The electrical heating of the hydrocarbon reservoir during the first time interval, in combination with any electrical heating of the hydrocarbon reservoir during the second time interval, is sufficient to maintain, during the second time interval, the hydrocarbon reservoir portion, that is surrounding the well 102, above the boiling point of the liquid heating fluid at the pressure of the hydrocarbon reservoir portion from which the mobilized hydrocarbon material is being produced. Because the temperature is so maintained, during the second time interval, condensed heating fluid may be re-evaporated, or substantially re-evaporated, prior to becoming disposed within the well 102, such that the collected reservoir fluid 110, which is being produced, is free, or substantially free, of any heating fluid. As well, because the production is being effected, pressure within the hydrocarbon reservoir is being reduced, such that the heating fluid is more likely to remain in a vapour state, as opposed to being condensed. In some embodiments, for example, the collected reservoir fluid 110 being collected within the well 102, and which is being produced, consists of, or substantially consists of, the mobilized hydrocarbon material. In parallel, because the electrical heating is suspended while the collected reservoir fluid 110 is being so produced, coking of the collected hydrocarbon material is mitigated. In this respect, the process includes:

(a) during a first time interval, while supplying a liquid heating fluid to the hydrocarbon reservoir through a well 102, electrically heating, within the well 102, with an electrical heater, a combined heating fluid including the supplied liquid heating fluid and a condensed heating fluid, such that the combined heating fluid is evaporated to produce a gaseous heating fluid that is conducted into the reservoir and then condensed upon heating of hydrocarbon material to produce the condensed heating fluid;

(b) suspending the supplying of the liquid heating fluid;

(c) after the suspending, and during a second time interval, reducing the rate at which heat energy is being delivered by the electric heater such that the rate at which heat energy is being delivered by the electric heater is less than 50% of the rate at which heat energy is being delivered by the electric heater during the first time interval, and while the electric heater is delivering the heat energy at the reduced rate, collecting reservoir fluid within the well 102, and producing the collected reservoir fluid 110, wherein the collected reservoir fluid 110 includes the heated hydrocarbon material that has become mobilized and drained into the well 102; and (d) suspending of the producing.

The electrical heating of the hydrocarbon reservoir during the first time interval, in combination with any electrical heating of the hydrocarbon reservoir during the second time interval, is sufficient to, during the second time interval, effect evaporation of condensed heating fluid, that has condensed after effecting heating and mobilization of the hydrocarbon material, wherein the evaporation of the condensed heating fluid is effected prior to the condensed heating fluid being received by the well 102.

In some embodiments, for example, the electrical heating of the hydrocarbon reservoir during the first time interval, in combination with any electrical heating of the hydrocarbon reservoir during the second time interval, is sufficient to effect evaporation of condensed heating fluid that has condensed after effecting heating and mobilization of the hydrocarbon material, prior to the condensed heating fluid being received by the well 102, such that the collected reservoir fluid is free, or substantially free, of heating fluid. In some embodiments, for example, the collected reservoir fluid consists of, or substantially consists of, the mobilized hydrocarbon material.

In some of these embodiments, for example, during the second time interval, the rate at which heat energy is being delivered by the electric heater is less than 25% of the rate at which heat energy is being delivered by the electric heater during the first time interval. In some of these embodiments, for example, during the second time interval, the electrical heating by the electrical heater is suspended.

In some embodiments, for example, the steps (a) to (d) are repeated at least once, such as, for example, at least twice, such as, for example, at least three (3) times, such as, for example, at least five (5) times. In this respect, in some embodiments, for example, the process is a cyclic process including steps (a) to (d), and the cyclic process is repeated at least once, such as, for example, at least twice, such as, for example, at least three (3) times, such as, for example, at least five (5) times.

In some embodiments, for example, during a first time interval when the collected reservoir fluid, within the well 102, is not being produced (such as, for example, when the production of the collected reservoir fluid is suspended), the electrical heating is such that the hydrocarbon reservoir becomes disposed above a predetermined temperature that is above the boiling point of the liquid heating fluid at the pressure of the hydrocarbon reservoir portion from which the mobilized hydrocarbon material is being produced (such as, for example, above 350 degrees Celsius). Subsequently, during a second time interval, the collected reservoir fluid 110 may be produced, and during such production, the electrical heating of the collected reservoir fluid may be continued but modulated such that the collected reservoir fluid 110 is disposed below 300 degrees Celsius, thereby mitigating coking of the collected reservoir fluid 110. In this respect, during the first time interval, the electrical heating is such that the hydrocarbon reservoir surrounding the well 102 becomes dry, or substantially dry, in that any heating fluid within this portion of the hydrocarbon reservoir, has become evaporated, and is being applied to effect heating and mobilization of hydrocarbon material within the reservoir. Further, in some embodiments, for example, the electrical heating during the first time interval may be sufficient to effect heating of liquid heating fluid being supplied to the hydrocarbon reservoir, via the well 102, to relatively high temperatures, including those which would otherwise promote coking of hydrocarbon material that is collected within collection reservoir of the well 102, so long as collection of the mobilized hydrocarbon material within the collection reservoir is avoided. During the first time interval, draining of the mobilized hydrocarbon material into the collection reservoir may be precluded by the high pressure conditions existing at the collection reservoir owing to the evaporation of the liquid heating fluid. During the second time interval, reservoir fluid, including the mobilized hydrocarbon material is draining and collecting within the production well 102, and is then subsequently produced. The electrical heating during the first time interval, in combination with any electrical heating during the second time interval, is sufficient to maintain, during the second time interval, the hydrocarbon reservoir portion, that is surrounding the well 102, above the boiling point of the liquid heating fluid at the pressure of the hydrocarbon reservoir portion from which the mobilized hydrocarbon material is being produced. Because the temperature is so maintained, condensed heating fluid is evaporated prior to becoming disposed within the well 102, such that the collected reservoir fluid 110 being collected within the well 102, and which is being produced, is free, or substantially free, of the heating fluid. As well, because the production is being effected, pressure within the hydrocarbon reservoir is being reduced, such that the heating fluid is more likely to remain in a vapour state, as opposed to being condensed. In some embodiments, for example, the collected reservoir fluid 100 consists of, or substantially consists of, the mobilized hydrocarbon material. In parallel, because the electrical heating is modulated such that such that the collected reservoir fluid 110 is disposed below 350 degrees Celsius, as described above, while the collected reservoir fluid 110 is being so produced, coking of the collected hydrocarbon material is mitigated. In this respect, the process includes:

(a) during a first time interval, while supplying a liquid heating fluid to the hydrocarbon reservoir through a well 102, electrically heating, within the well 102, a combined heating fluid including the supplied liquid heating fluid and a condensed heating fluid, such that the combined heating fluid is evaporated to produce a gaseous heating fluid that is conducted into the reservoir, and then condensed upon heating of hydrocarbon material to produce the condensed heating fluid;

(b) suspending the supplying of the liquid heating fluid;

(c) after the suspending of the supplying of the liquid heating fluid, during a second time interval, modulating the electrical heating such that the electrical heating of reservoir fluid (including the mobilized hydrocarbon material, and, in some embodiments, for example, consisting, or substantially consisting of the mobilized hydrocarbon material) that is being collected within the well 102 is such that the temperature of the collected reservoir fluid 110 is less than 350 degrees Celsius (such as, for example, less than 350 degrees Celsius, such as, for example, less than 300 degrees Celsius, such as, for example, less than 250 degrees Celsius, such as, for example, less than 220 degrees Celsius), and, while the modulated electrical heating of collected reservoir fluid is being effected, producing the collected reservoir fluid 110 from the well 102; and (c) suspending the producing.

The electrical heating of the hydrocarbon reservoir during the first time interval, in combination with any electrical heating of the hydrocarbon reservoir during the second time interval, is sufficient to, during the second time interval, effect evaporation of condensed heating fluid, that has condensed after effecting heating and mobilization of the hydrocarbon material, prior to the condensed heating fluid being received by the well 102.

In some embodiments, for example, the electrical heating of the hydrocarbon reservoir during the first time interval, in combination with any electrical heating of the hydrocarbon reservoir during the second time interval, is sufficient to, during the second time interval, effect evaporation of condensed heating fluid, that has condensed after effecting heating and mobilization of the hydrocarbon material, prior to the condensed heating fluid being received by the well 102, such that the collected reservoir fluid 110 is free, or substantially free, of the heating fluid. In some embodiments, for example, the collected reservoir fluid 110 consists of, or substantially consists of, the mobilized hydrocarbon material.

In some embodiments, for example, the modulating of the electrical heating includes suspending of the electrical heating.

In some embodiments, for example, the steps (a) to (d) are repeated at least once, such as, for example, at least twice, such as, for example, at least three (3) times, such as, for example, at least five (5) times. In this respect, in some embodiments, for example, the process is a cyclic process including steps (a) to (d), and the cyclic process is repeated at least once, such as, for example, at least twice, such as, for example, at least three (3) times, such as, for example, at least five (5) times.

In some embodiments, for example, during the first time interval, the evaporated combined heating fluid is superheated such that the temperature of the hydrocarbon reservoir becomes disposed above the boiling point of the liquid heating fluid at the pressure of the hydrocarbon reservoir portion from which the mobilized hydrocarbon material is being produced. In this respect, in some embodiments, for example, the predetermined temperature is above 300 degrees Celsius, such as, for example, above 350 degrees Celsius, such as, for example, above 400 degrees Celsius.

By effecting heating of the hydrocarbon reservoir to above the predetermined temperature, the reservoir fluid, that is being collected within the well and then produced, is free, or substantially free, of the condensed heating fluid. In some embodiments, for example, consists of, or substantially consists of, the mobilized hydrocarbon material.

As discussed above, in some embodiments, for example, the collected reservoir fluid 110 consists of, or substantially consists of, the mobilized hydrocarbon material, and, in this respect, is free, or substantially free, of the heating fluid. In those embodiments where the electric heater 104 is disposed in direct heat transfer communication with the collected reservoir fluid, by having the collected reservoir fluid consisting of, or substantially consisting of, the mobilized hydrocarbon material, evaporation of condensed heating fluid disposed in heat transfer communication with the collected reservoir fluid, may produce evaporated heating fluid having a relatively higher temperature, owing to the fact that the mobilized hydrocarbon material can be heated to higher temperatures by the electric heater, and transfer this higher quality heat to any condensed heating fluid disposed in heat transfer communication with the collected reservoir fluid, versus direct heating of the condensed heating fluid by the electric heater (without any intervening liquid heat transfer medium 704).

Also, by having the collected reservoir fluid 110 be free, or substantially free, of the heating fluid, scale formation within the production well 102 may be mitigated. Where the heating fluid, in its liquid state, includes water, it is preferable that water does not become disposed in contact structures within the production well, including the electric heater 104, as evaporation of water in this context may result in precipitation of dissolved scale-forming solids within the production well 102, including onto the electric heater or other structures, resulting in scale formation. This may be particularly relevant where the water includes connate water (and is, therefore, not possible to subject to pre-treatment for removal of scale-forming solids), and is most likely to occur during initial start-up. Accordingly, in such embodiments, by ensuring that the collected reservoir fluid is free, or substantially free, of the heating fluid, the collected heating fluid is fluidically isolated, or substantially fluidically isolated, from the production well, thereby mitigating potential scale formation within the production well (including scale formation on the electric heater).

Further, as a necessary incident, by having the collected reservoir fluid 110 be free, or substantially free, of the heating fluid, production of a "drier" hydrocarbon material is facilitated. This reduces energy requirements to transport the produced fluid to the surface (as there is less fluid volume to produce) and also reduces demands on separation processes for removal of heating fluid from the produced fluids.

In this respect, in some embodiments, for example, the rate of heating of the collected reservoir fluid 110 by the electric heater 104 is modulated such that the collected reservoir fluid is free, or substantially free, of the heating fluid. In some embodiments, for example, the rate of heating of the collected reservoir fluid 110 by the electric heater 104 is modulated such that the collected reservoir fluid consists of, or substantially consists of, the mobilized hydrocarbon material.

In some embodiments, for example, the composition of the collected reservoir fluid 110 may be sensed by a densitometer. In this respect, the rate of heating effected by the electric heater 104 may be modulated based on sensing of the density of the collected reservoir fluid by the densitometer. In response to sensing of a density of the collected reservoir fluid that is characteristic of a collected reservoir fluid having excessive non-hydrocarbon fluid (such as the heating fluid), the rate of heating by the electric heater may be increased to effect evaporation of the fluid. This will promote the maintenance of a collected reservoir fluid that consists of hydrocarbon material, or substantially hydrocarbon material, and, in this respect, free, or substantially free, of the heating fluid. This promotes reflux of the condensed heating fluid (as above-described), higher quality heat transfer to effect the evaporation of the condensed heating fluid, mitigates scale formation, and production of "drier" hydrocarbon material.

Alternatively, the amount of water within the produced reservoir fluid can be detected by measuring electrical resistance of the produced reservoir fluid, capacitance of the produced reservoir fluid, or both of electrical resistance and capacitance of the produced reservoir fluid, and the rate of heating by the electric heater may be modulated in response to this measurement.

In some embodiments, for example, the electric heater 104 is submerged within the collected reservoir fluid 110 (in some embodiments, for example, free of, substantially free of the heating fluid, and in some embodiments, for example, consisting of hydrocarbon material, or substantially hydrocarbon material), and the producing is modulated such that sufficient collected reservoir fluid is maintained within the production well 102 such that the electric heater is submerged within collected reservoir fluid.

In those embodiments where the temperature of the collected reservoir fluid is above the boiling point of the liquid heating fluid at the pressure of the hydrocarbon reservoir portion from which the mobilized hydrocarbon material is being produced, the collected reservoir fluid is produced, such that the collected reservoir fluid is conducted to above the surface of the earth.

In some embodiments, for example, the temperature of the collected reservoir fluid is between: (i) a temperature that is 10 degrees Celsius above the steam saturation temperature at the pressure within the hydrocarbon reservoir, and (ii) 350 degrees Celsius. In some embodiments, for example, the collected reservoir fluid 110 is free, or substantially free, of the heating fluid. In some embodiments, for example, the collected reservoir fluid 110 consists of, or substantially consists of, mobilized hydrocarbon material. Once disposed above the surface of the earth (such as, for example, within the surface facilities), the produced reservoir fluid becomes disposed in indirect heat exchange communication with a heat transfer fluid such that heat is indirectly transferred to the heat transfer fluid. The transferring of heat to the heat transfer fluid is such that the heat transfer fluid is evaporated. The evaporated heat transfer fluid is communicated to a turbine such that rotation of the turbine is effected, such that electricity is generated.

In some embodiments, for example, the laterally, or substantially laterally, extending section 102*a* of the production well 102 is co-operatively configured with the electric heater 104 such that while the reservoir fluid is being conducted towards the well 102, the laterally, or substantially laterally, extending section 102*a* of the production well 102 is disposed to receive and collect the reservoir fluid across (but not necessarily continuously across) a reservoir fluid-receiving portion of the laterally, or substantially laterally, extending section of the production well 102, and the length of the reservoir fluid-receiving portion, measured along the axis of the operative portion, is at least 1000 meters. Because the heating fluid is not supplied from the surface, heat losses, associated with longer wells, is not concerning, as it is for SAGD operations. Also, because the volumetric flow of produced fluid is relatively less than for SAGD production, hydraulic pressure losses are also not a material factor for well design. In combination, this enables the use of longer wells in in-situ reflux operations to effect production of hydrocarbon material, although shorter wells (i.e. those less than 1000 meters) could also be used.

In some embodiments, for example, the vertically, or substantially vertically, extending section 102*b* of the production well 102 has a length, measured along the axis of the vertically, or substantially vertically, extending section, of at least 1000 meters, so as to allow for production from deeper resources. Again, heat losses and hydraulic pressure losses, with in-situ reflux are not concerning, as it is for SAGD operations, and it is, possible to, therefore, use longer wells, although shorter wells (i.e. those less than 1000 meters in depth) could also be used.

Liquid heating fluid may be supplied from a source disposed above the surface 1002. In some embodiments, for example, the supplying of liquid heating fluid is effected via an injector string 114 disposed within the production well 102. In some embodiments, for example, the injector string includes a "spaghetti string".

Supplying of liquid heating fluid may be suspended, when sufficient refluxing of previously supplied liquid heating fluid, connate water, or both is being effected such that the desirable production of reservoir fluid is effected (for example, the produced reservoir fluid is free, or substantially free, of heating fluid, and/or, for example, the produced reservoir fluid consists of, or substantially consists of, hydrocarbon material). In some cases, after the supplying has been suspended, periodic make-up of heating fluid may be required. For example, liquid heating fluid may be lost to the reservoir 1000, and make-up heating fluid may be required. In this respect, while the heating of a liquid heating fluid is being effected, supplemental liquid heating fluid 116 may be supplied from a source disposed above the surface 1002. In this respect, the liquid heating fluid includes the supplemental liquid heating fluid 116. In some embodiments, for example, the supplying of supplemental liquid heating fluid 116 is effected via an injector string 114 disposed within the production well 102. In some embodiments, for example, the injector string includes a "spaghetti string". In some embodiments, for example, the supplying of the supplemental liquid heating fluid is effected in response to sensing of a pressure, within the hydrocarbon reservoir portion from which the mobilized hydrocarbon material is being produced, that is less than a predetermined pressure. The predetermined pressure is based on, amongst other things, the desirability of operating at higher pressures in order to provide a greater driving force for production, balanced versus the recognition that heat transfer efficiency is greater at lower pressures and that cap rock integrity may limit the maximum possible operating pressure.

In operation, during start-up, the hydrocarbon reservoir is heated by heat generated by the electric heater, such that hydrocarbon material is mobilized by the heating of the hydrocarbon reservoir. The mobilized hydrocarbon material drains into the production well 102.

The heating is effected by conduction, convection, or a combination of conduction and convection. In some embodiments, for example, the convective heating is effected by evaporated formation water, such that the heating fluid includes evaporated formation water. Subsequently, or, in parallel, heating fluid is supplied from the surface facilities and is injected into the reservoir. Evaporation of the injected heating fluid is effected by the heat generated by the electric heater 104. The evaporated heating fluid is conducted to the hydrocarbon reservoir and transfers heat energy to the hydrocarbon material such that the hydrocarbon material is mobilized and the heating fluid is condensed. Reservoir fluid 110 enters the production well 102 via ports 106, collects within the collection reservoir 108 and is electrically heated by the electric heater 104 (either directly or via the heater assembly 106). Heating is controlled such that the reservoir fluid is, primarily, collected mobilized hydrocarbon material. The heated reservoir fluid transfers heat to condensed heating fluid that is disposed in heat transfer communication with the reservoir fluid, thereby effecting re-evaporation of the condensed heating fluid, and thereby effecting the reflux 112. Eventually, after sufficient hydrocarbon material has been mobilized and drained into the production well 102 (such as, for example, as described above), an evaporated heat fluid chamber develops (where the heating fluid, in the liquid state, is water, then a steam chamber would be developed). In parallel, reservoir fluid collected within the production well 104 is continuously produced, such as by a downhole pump and/or artificial lift, or by reservoir pressure.

Figure 2:
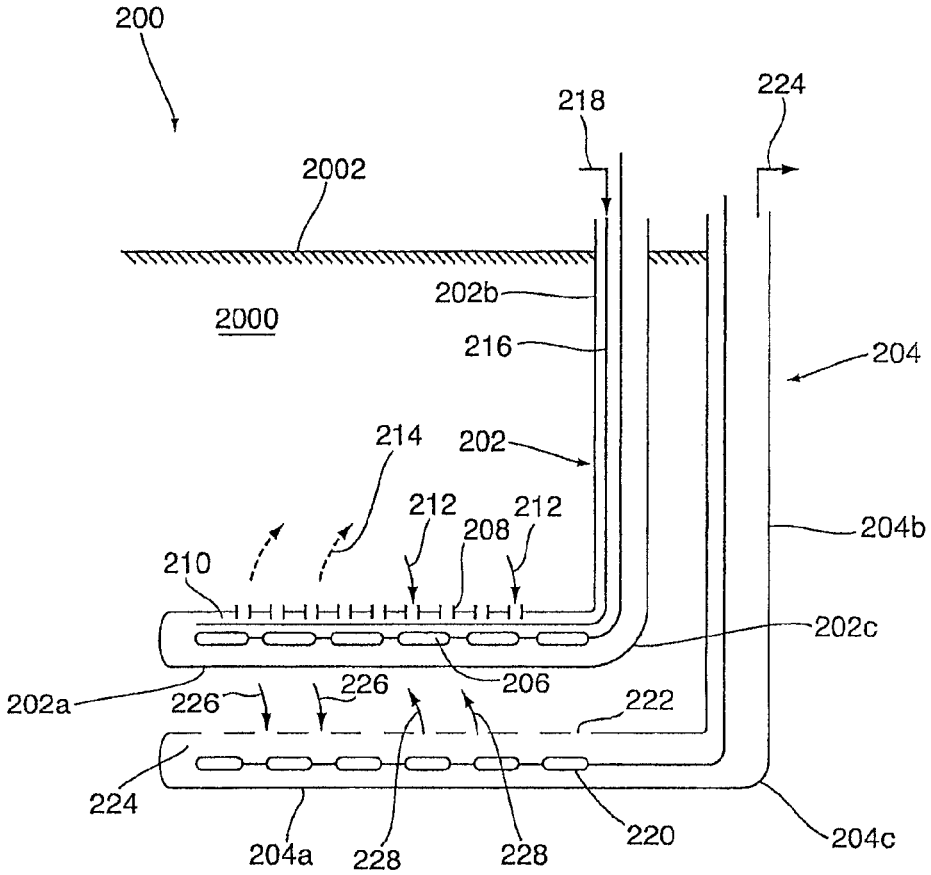
FIG. 2 is a schematic illustration of an embodiment of a system, with a non-production well and a production well, used to implement the in-situ reflux process.

Referring to FIG. 2, in some embodiments, for example, in-situ reflux may be effected by a system 200 including a non-production well 202 and a production well 204. A first electric heater 206 is disposed within the non-production well 202. At least a fraction of the reflux is effected by a first electric heater 206. The producing of the produced fluid 224 is effected via the production well 204. The production well 204 is disposed below the non-production well 202. The non-production well 202 does not produce produced fluid 224. The non-production well is provided for, amongst other things, to effect reflux of the heating fluid. In comparison to the embodiment illustrated in FIG. 1, this configuration may enable recovery and production of hydrocarbon material that is disposed closer to the bottom of the hydrocarbon reservoir, with less energy losses to the formation below the hydrocarbon reservoir without any hydrocarbon reserves.

The non-production well 202 extends into the hydrocarbon reservoir 2000 from the surface. In some embodiments, for example, the first electric heater 206 is disposed within a laterally extending section 202*a* of the non-production well 202, that extends from a vertically extending section 202*b*, at the heel 202*c* of the non-production well 202. In some embodiments, for example, the laterally extending section 202*a* is disposed along a horizontal, or substantially horizontal, axis.

In some embodiments, for example, the first electric heater 206 is disposed within the collection reservoir 210 of the non-production well 202. The collection reservoir 210 includes reservoir fluid 212 that has collected therein. In some embodiments, for example, the collected reservoir fluids 212 is free, or substantially free, of the heating fluid. In some embodiments, for example, the collected reservoir fluids 212 consists of, or substantially consists of, the mobilized hydrocarbon material. The collected mobilized hydrocarbon material is disposed in heat transfer communication with at least a fraction of the condensed heating fluid, such as condensed heating fluid that is disposed externally of the non-production well 202. In some embodiments, for example, the collected reservoir fluid may also include the condensed heating fluid.

The first electric heater 206 is configured for effecting heating of the collected reservoir fluid 212. In some embodiments, for example, the first electric heater is disposed in direct heat transfer communication with the collected reservoir fluid. Heating of any condensed heating fluid, whether disposed as part of the collected reservoir fluid, or disposed in heat transfer communication with the collected reservoir fluid, externally of the production well, is, therefore, effected by the first electric heater, when the first electric heater is heating the collected reservoir fluid. In some embodiments, for example, the electrical heating by the first electric heater 206 is such that the collected reservoir fluid is free, or substantially free, of heating fluid. In some embodiments, for example, the electrical heating by the first electric heater 206 is such that the collected reservoir fluid consists of, or substantially consists of, the mobilized hydrocarbon material.

Referring to FIG. 8, in some embodiments, for example, the first electric heater 206 is part of a heating assembly 700, such that the electric heater is in indirect heat transfer communication with the collected reservoir fluid via a liquid heat transfer medium 704. An example of a suitable liquid heat transfer medium 704 is glycerin. In this respect, a heating assembly 700 is provided, and includes a housing 702, the electric heater, and the liquid heat transfer medium 704. The electric heater is disposed within a housing 702, with the space between the electric heater and the housing 702 being occupied with the liquid heat transfer medium 704. The liquid heat transfer medium 704 has a higher boiling point than that of the heating fluid at the pressure of the hydrocarbon reservoir portion from which the mobilized hydrocarbon material is being produced, such as by at least 10 degrees Celsius, such as, for example, by at least 20 degrees Celsius, such as, for example, by at least 50 degrees Celsius, such as, for example, by at least 100 degrees Celsius. The collection reservoir 210 is defined by a space within the non-production well 202, between the housing 702 and the wellbore string (such as, for example, casing) of the non-production well 202. Because the heater assembly is disposed within the collection reservoir, the liquid heat transfer medium 704 is disposed in heat transfer communication with the collected reservoir fluid 212, through the wall of the housing 702. In this respect, heat is transferred from the first electric heater to the collected reservoir fluid via the liquid heat transfer medium 704 and through the wall of the housing 702. By virtue of this configuration, any evaporated heating fluid may become disposed at a relatively higher temperature, owing to the fact that the liquid heat transfer medium 704 can be heated to higher temperatures by the first electric heater, and transfer this higher quality heat to the reservoir fluids (and, therefore, to the condensed heating fluid), versus direct heating of the reservoir fluids by the first electric heater (without any intervening liquid heat transfer medium 704).

In some embodiments, for example, the first electric heater 206 is disposed within a laterally extending section 202*a* of the non-production well 202, that extends from a vertically extending section 202*b*, at the heel 202*c* of the non-production well 202. In some embodiments, for example, the laterally extending section 202*a* is disposed along a horizontal, or substantially horizontal, axis.

In some embodiments, for example, the first electric heater 206 includes a plurality of heater segments, and each one of the heater segments may be controllable independently from the other heater segments in terms of the rate of energy being produced. By providing a plurality of heater segments that are independently controllable, improved control of heating fluid conformance is made possible.

In some embodiments, for example, the electrical heating of the collected reservoir fluid 212 is such that the temperature of the collected reservoir fluid is greater than or equal to at least the boiling point of the liquid heating fluid at the pressure of the hydrocarbon reservoir portion from which the mobilized hydrocarbon material is being produced. In this respect, both of (i) evaporation of the heating fluid that is disposed in heat transfer communication with the collected reservoir fluid, but externally of the collection reservoir 210, and (ii) evaporation of any heating fluid that is present within the collected reservoir fluid, is promoted, so as to return the heating fluid to the reservoir for effecting mobilization of the hydrocarbon material within the reservoir 2000, and thereby contribute to the refluxing.

In some embodiments, for example, the electrical heating of the collected reservoir fluid 212 is effected in response to sensing of a temperature, of the collected reservoir fluid, that is at or below a predetermined temperature that is based upon the boiling point of the liquid heating fluid at the pressure of the hydrocarbon reservoir portion from which the mobilized hydrocarbon material is being produced. In some embodiments, prior to the electrical heating of the collected reservoir fluid, a temperature of the collected reservoir fluid is sensed that is at or below a predetermined temperature that is based upon the boiling point of the liquid heating fluid at the pressure of the hydrocarbon reservoir portion from which the mobilized hydrocarbon material is being produced. In some embodiments, for example, the predetermined temperature is at or above the boiling point of the liquid heating fluid at the pressure of the hydrocarbon reservoir portion from which the mobilized hydrocarbon material is being produced. The purpose of having the predetermined temperature being at the boiling point of the liquid heating fluid at the pressure of the hydrocarbon reservoir portion from which the mobilized hydrocarbon material is being produced, is for evaporating liquid heating fluid that has collected within the well or is in close proximity to the well. Liquid heating fluid that has collected within the well would be disposed at or below the boiling point of the liquid heating fluid at the pressure of the hydrocarbon reservoir portion from which the mobilized hydrocarbon material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon material is being produced, the intention is to vaporize the liquid heating fluid that has collected within the well as part of the collected reservoir fluid. In some embodiments, for example, it may be intended to vaporize the heating fluid that is disposed externally of the well, in which case the predetermined temperature may be above the boiling point of the liquid heating fluid at the pressure of the hydrocarbon reservoir portion from which the mobilized hydrocarbon material is being produced, for purposes of precluding collection of the heating fluid within the well.

In some embodiments, for example, the non-production well 202 includes the heel 202*c*. In this respect, the electrical heating of the collected reservoir fluid by the electric heater 206 is such that the temperature of the collected reservoir fluid, disposed at the heel 202*c* of the non-production well 202, is greater than or equal to the boiling point of the liquid heating fluid at the pressure of the hydrocarbon reservoir portion from which the mobilized hydrocarbon material is being produced. Similar to the above, both of (i) evaporation of the heating fluid that is disposed in heat transfer communication with the collected reservoir fluid, but externally of the collection reservoir, and (ii) evaporation of any heating fluid that is present within the collected reservoir fluid, is promoted, so as to return the heating fluid to the reservoir for effecting mobilization of the hydrocarbon material within the reservoir, and thereby contribute to the refluxing.

In some embodiments, for example, the electrical heating of the collected reservoir fluid by the first electric heater 206 is effected in response to sensing of a temperature, of the collected reservoir fluid disposed at the heel 202*c* of the non-production well 202, that is at or below a predetermined temperature that is based upon the boiling point of the liquid heating fluid at the pressure of the hydrocarbon reservoir portion from which the mobilized hydrocarbon material is being produced. In some embodiments, for example, prior to the electrical heating of the collected reservoir fluid by the first electric heater 206, a temperature, of the collected reservoir fluid that is disposed at the heel 202*c* of the non-production well 202, is sensed that is at or below a predetermined temperature that is based upon the boiling point of the liquid heating fluid at the pressure of the hydrocarbon reservoir portion from which the mobilized hydrocarbon material is being produced. In some embodiments, for example, the predetermined temperature is at or above the boiling point of the liquid heating fluid at the pressure of the hydrocarbon reservoir portion from which the mobilized hydrocarbon material is being produced. The purpose of having the predetermined temperature being at the boiling point of the liquid heating fluid at the pressure of the hydrocarbon reservoir portion from which the mobilized hydrocarbon material is being produced, is for evaporating liquid heating fluid that has collected within the well. Liquid heating fluid that has collected within the well would be disposed at or below the boiling point of the liquid heating fluid at the pressure of the hydrocarbon reservoir portion from which the mobilized hydrocarbon material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon material is being produced, the intention is to vaporize the liquid heating fluid that has collected within the well as part of the collected reservoir fluid. In some embodiments, for example, it may be intended to vaporize the heating fluid that is disposed externally of the well, in which case the predetermined temperature may be above the boiling point of the liquid heating fluid at the pressure of the hydrocarbon reservoir portion from which the mobilized hydrocarbon material is being produced, for purposes of precluding collection of the heating fluid within the well.

As discussed above, in some embodiments, for example, the collected reservoir fluid 212 consists of, or substantially consists of, the mobilized hydrocarbon material, and, in this respect, is free, or substantially free, of the heating fluid. In those embodiments where the first electric heater is disposed in direct heat transfer communication with the collected reservoir fluid, by having the collected reservoir fluid consisting of, or substantially consisting of, the mobilized hydrocarbon material (and, in this respect, free, or substantially free, of the heating fluid) evaporation of condensed heating fluid disposed in heat transfer communication with the collected reservoir fluid, may produce evaporated heating fluid having a relatively higher temperature, owing to the fact that the mobilized hydrocarbon material can be heated to higher temperatures by the first electric heater 206, and transfer this higher quality heat to any condensed heating fluid disposed in heat transfer communication with the collected reservoir fluid, versus direct heating of the condensed heating fluid by the first electric heater (without any intervening liquid heat transfer medium 704).

Also, by having the collected reservoir fluid 212 be free, or substantially free, of the heating fluid, scale formation within the non-production well 202 may be mitigated. Where the heating fluid, in its liquid state, includes water, it is preferable that water does not become disposed in contact structures within the non-production well 202, including the first electric heater 206, as evaporation of water in this context may result in precipitation of dissolved scale-forming solids within the non-production well, including onto the first electric heater or other structures, resulting in scale formation. Accordingly, in such embodiments, by ensuring that the collected reservoir fluid be free, or substantially free, of the heating fluid, the collected heating fluid is fluidically isolated, or substantially fluidically isolated, from the non-production well, thereby mitigating potential scale formation within the non-production well (including scale formation on the second electric heater 220).

In this respect, in some embodiments, for example, the rate of heating of the collected reservoir fluid 212 by the first electric heater 206 is modulated such that the collected reservoir fluid is free, or substantially free, of the heating fluid. In some embodiments, for example, the rate of heating of the collected reservoir fluid 212 by the first electric heater 206 is modulated such that the collected reservoir fluid consists of, or substantially consists of, the mobilized hydrocarbon material.

In some embodiments, for example, the composition of the collected reservoir fluid 212 may be sensed by a densitometer. In this respect, the rate of heating effected by the first electric heater 206 may be modulated based on sensing of the density of the collected reservoir fluid by the densitometer. In response to sensing of a density of the collected reservoir fluid that is characteristic of a collected reservoir fluid having excessive non-hydrocarbon fluid (such as the heating fluid), the rate of heating by the second electric heater 220 may be increased to effect evaporation of the fluid. This will promote the maintenance of a collected reservoir fluid that consists of hydrocarbon material, or substantially hydrocarbon material, and, in this respect, is free, or substantially free, of the heating fluid. Amongst other things, this promotes reflux of the condensed heating fluid (as above-described), higher quality heat transfer to effect the evaporation of the condensed heating fluid, and mitigates scale formation.

Alternatively, the amount of water within the produced reservoir fluid can be detected by measuring electrical resistance of the produced reservoir fluid, capacitance of the produced reservoir fluid, or both of electrical resistance and capacitance of the produced reservoir fluid, and the rate of heating by the electric heater may be modulated in response to this measurement.

The produced fluid 224 is produced through the production well 204. In some embodiments, for example, production is effected by artificial lift, such as by a downhole pump and/or by gas lift.

The production well 204 extends into the hydrocarbon reservoir from the surface. The production well 204 includes a collection reservoir 224 for collecting reservoir fluids 226. The reservoir fluids include mobilized hydrocarbon material and condensed heating fluid. In some embodiments, for example, the reservoir fluid being collected within the production well is free, or substantially free, of the heating fluid. In some embodiments, for example, the reservoir fluid being collected within the production well consists of, or substantially consists of, mobilized hydrocarbon material. Such collected reservoir fluid may be in heat transfer communication with condensed heating fluid that has bypassed the non-production well 202. In some embodiments, for example, the collected reservoir fluid may include the mobilized hydrocarbon material and condensed heating fluid that has bypassed the non-production well 202. The condensed heating fluids are more likely to be disposed in such relationships with the collected reservoir fluid in later-stage in-situ reflux processes being practised within oil sands. In more mature operations, the steam chamber tends to laterally grow, resulting in condensed heating fluid bypassing the non-production well 202 while draining within the reservoir.

In some embodiments, for example, it may be desirable to remove condensed heating fluid from the reservoir fluid 224 being collected within the production well 204, prior to production of the reservoir fluid, as well as to reflux such condensed heating fluid that has bypassed the non-production well 202.

In this respect, a second electric heater 220 is disposed within the production well and, more specifically, within the collection reservoir 224 of the production well 204. The collection reservoir includes reservoir fluid that has collected therein.

The second electric heater 220 is configured for effecting heating of the collected reservoir fluid 226. In some embodiments, for example, the second electric heater is disposed in direct heat transfer communication with the collected reservoir fluid. Heating of any condensed heating fluid, whether disposed as part of the collected reservoir fluid, or disposed in heat transfer communication with the collected reservoir fluid, externally of the production well 204, is, therefore, effected by the second electric heater, when the second electric heater is heating the collected reservoir fluid. In some embodiments, for example, the electrical heating by the second electric heater 220 is such that the collected reservoir fluid is free, or substantially free, of heating fluid. In some embodiments, for example, the electrical heating by the second electric heater 220 is such that the collected reservoir fluid consists of, or substantially consists of, the mobilized hydrocarbon material.

Referring to FIG. 8, in some embodiments, for example, the second electric heater 220 is part of a heating assembly 700, such that the second electric heater is in indirect heat transfer communication with the collected reservoir fluid 226 via a liquid heat transfer medium 704. An example of a suitable liquid heat transfer medium 704 is glycerin. In this respect, a heating assembly 700 is provided, and includes a housing 702, second the electric heater, and the liquid heat transfer medium 704. The second electric heater is disposed within a housing 702, with the space between the second electric heater and the housing 702 being occupied with the liquid heat transfer medium 704. The liquid heat transfer medium 704 has a higher boiling point than that of the heating fluid at the pressure of the hydrocarbon reservoir portion from which the mobilized hydrocarbon material is being produced, such as by at least 10 degrees Celsius, such as, for example, by at least 20 degrees Celsius, such as, for example, by at least 50 degrees Celsius, such as, for example, by at least 100 degrees Celsius. The collection reservoir 224 is defined by a space within the production well, between the housing 702 and the casing of the production well 204. Because the heater assembly is disposed within the collection reservoir, the liquid heat transfer medium 704 is disposed in heat transfer communication with the collected reservoir fluid, through the wall of the housing 702. In this respect, heat is transferred from the second electric heater to the collected reservoir fluid via the liquid heat transfer medium 704 and through the wall of the housing 702. By virtue of this configuration, any evaporated heating fluid may become disposed at a relatively higher temperature, owing to the fact that the liquid heat transfer medium 704 can be heated to higher temperatures by the second electric heater, and transfer this higher quality heat to the reservoir fluids (and, therefore, to the condensed heating fluid), versus direct heating of the reservoir fluids by the second electric heater (without any intervening liquid heat transfer medium 704). This also facilitates production of a "drier" hydrocarbon material.

In some embodiments, for example, the second electric heater 220 is disposed within a laterally extending section 204*a* of the production well 204, that extends from a vertically extending section 204*b*, at the heel 204*c* of the production well 204. In some embodiments, for example, the laterally extending section 204*a* is disposed along a horizontal, or substantially horizontal, axis.

In some embodiments, for example, the second electric heater 220 includes a plurality of heater segments, and each one of the heater segments may be controllable independently from the other heater segments in terms of the rate of energy being produced. By providing a plurality of heater segments that are independently controllable, improved control of heating fluid conformance is made possible.

In some embodiments, for example, the electrical heating of the collected reservoir fluid 226 is such that the temperature of the collected reservoir fluid is greater than or equal to at least the boiling point of the liquid heating fluid at the pressure of the hydrocarbon reservoir portion from which the mobilized hydrocarbon material is being produced. In this respect, both of (i) evaporation of the heating fluid that is disposed in heat transfer communication with the collected reservoir fluid, but externally of the collection reservoir, and (ii) evaporation of any heating fluid that is present within the collected reservoir fluid, is promoted, so as to return the heating fluid to the reservoir for effecting mobilization of the hydrocarbon material within the reservoir, and thereby contribute to the refluxing. As well, by promoting the evaporation, the produced fluid 224 that is being produced contains less heating fluid, thereby reducing energy requirements to transport the produced fluid to the surface (as there is less fluid volume to produce), and also reducing demands on separation processes for removal of heating fluid from the produced fluids.

In some embodiments, for example, the electrical heating of the collected reservoir fluid 226 is effected in response to sensing of a temperature, of the collected reservoir fluid, that is at or below a predetermined temperature that is based upon the boiling point of the liquid heating fluid at the pressure of the hydrocarbon reservoir portion from which the mobilized hydrocarbon material is being produced. In some embodiments, prior to the electrical heating of the collected reservoir fluid, a temperature of the collected reservoir fluid is sensed that is at or below a predetermined temperature that is based upon the boiling point of the liquid heating fluid at the pressure of the hydrocarbon reservoir portion from which the mobilized hydrocarbon material is being produced. In some embodiments, for example, the predetermined temperature is at or above the boiling point of the liquid heating fluid at the pressure of the hydrocarbon reservoir portion from which the mobilized hydrocarbon material is being produced. The purpose of having the predetermined temperature being at the boiling point of the liquid heating fluid at the pressure of the hydrocarbon reservoir portion from which the mobilized hydrocarbon material is being produced, is for evaporating liquid heating fluid that has collected within the well. Liquid heating fluid that has collected within the well would be disposed at or below the boiling point of the liquid heating fluid at the pressure of the hydrocarbon reservoir portion from which the mobilized hydrocarbon material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon material is being produced, the intention is to vaporize the liquid heating fluid that has collected within the well as part of the collected reservoir fluid. In some embodiments, for example, it may be intended to vaporize the heating fluid that is disposed externally of the well, in which case the predetermined temperature may be above the boiling point of the liquid heating fluid at the pressure of the hydrocarbon reservoir portion from which the mobilized hydrocarbon material is being produced, for purposes of precluding collection of the heating fluid within the well.

In some embodiments, for example, the production well 204 includes the heel 204*c*. In this respect, the electrical heating of the collected reservoir fluid 226 by the second electric heater 220 is such that the temperature of the collected reservoir fluid, disposed at the heel 204*c* of the production well 204, is greater than or equal to the boiling point of the liquid heating fluid at the pressure of the hydrocarbon reservoir portion from which the mobilized hydrocarbon material is being produced. Similar to the above, both of (i) evaporation of the heating fluid that is disposed in heat transfer communication with the collected reservoir fluid, but externally of the collection reservoir, and (ii) evaporation of any heating fluid that is present within the collected reservoir fluid, is promoted, so as to return the heating fluid to the reservoir for effecting mobilization of the hydrocarbon material within the reservoir, and thereby contribute to the refluxing. As well, by promoting the evaporation, the produced fluid 224 that is being produced contains less heating fluid, thereby reducing energy requirements to transport the produced fluid to the surface (as there is less fluid volume to produce), and also reducing demands on separation processes for removal of heating fluid from the produced fluids.

In some embodiments, for example, the electrical heating of the collected reservoir fluid 226 by the second electric heater 220 is effected in response to sensing of a temperature, of the collected reservoir fluid disposed at the heel 204*c* of the production well 204, that is at or below a predetermined temperature that is based upon the boiling point of the liquid heating fluid at the pressure of the hydrocarbon reservoir portion from which the mobilized hydrocarbon material is being produced. In some embodiments, for example, prior to the electrical heating of the collected reservoir fluid by the second electric heater, a temperature, of the collected reservoir fluid that is disposed at the heel 204*c* of the production well 204, is sensed that is at or below a predetermined temperature that is based upon the boiling point of the liquid heating fluid at the pressure of the hydrocarbon reservoir portion from which the mobilized hydrocarbon material is being produced. In some embodiments, for example, the predetermined temperature is at or above the boiling point of the liquid heating fluid at the pressure of the hydrocarbon reservoir portion from which the mobilized hydrocarbon material is being produced. The purpose of having the predetermined temperature being at the boiling point of the liquid heating fluid at the pressure of the hydrocarbon reservoir portion from which the mobilized hydrocarbon material is being produced, is for evaporating liquid heating fluid that has collected within the well. Liquid heating fluid that has collected within the well would be disposed at or below the boiling point of the liquid heating fluid at the pressure of the hydrocarbon reservoir portion from which the mobilized hydrocarbon material is being produced (where the heating fluid, in the liquid state, is water, this would be the saturated steam temperature within the reservoir). By effecting electrical heating while the collected reservoir fluid is disposed at or below the boiling point of the liquid heating fluid at the pressure of the hydrocarbon reservoir portion from which the mobilized hydrocarbon material is being produced, the intention is to vaporize the liquid heating fluid that has collected within the well as part of the collected reservoir fluid. In some embodiments, for example, it may be intended to vaporize the heating fluid that is disposed externally of the well, in which case the predetermined temperature may be above the boiling point of the liquid heating fluid at the pressure of the hydrocarbon reservoir portion from which the mobilized hydrocarbon material is being produced, for purposes of precluding collection of the heating fluid within the well.

As discussed above, in some embodiments, for example, the collected reservoir fluid 226 consists of, or substantially consists of, the mobilized hydrocarbon material. In those embodiments where the second electric heater 206 is disposed in direct heat transfer communication with the collected reservoir fluid, by having the collected reservoir fluid consisting of, or substantially consisting of, the mobilized hydrocarbon material, evaporation of condensed heating fluid, disposed in heat transfer communication with the collected reservoir fluid, may produce evaporated heating fluid having a relatively higher temperature, owing to the fact that the mobilized hydrocarbon material can be heated to higher temperatures by the second electric heater, and transfer this higher quality heat to any condensed heating fluid disposed in heat transfer communication with the collected reservoir fluid, versus direct heating of the condensed heating fluid by the second electric heater (without any intervening liquid heat transfer medium 704).

Also, by having the collected reservoir fluid 226 be free, or substantially free, of the heating fluid, scale formation within the production well 204 may be mitigated. Where the heating fluid, in its liquid state, includes water, it is preferable that water does not become disposed with structures within the production well, including the second electric heater 206, as evaporation of water in this context may result in precipitation of dissolved scale-forming solids within the production well, including onto the second electric heater or other structures, resulting in scale formation. Accordingly, in such embodiments, by ensuring that the collected reservoir fluid is free, or substantially free, of the heating fluid, the collected heating fluid is fluidically isolated, or substantially fluidically isolated, from the production well, thereby mitigating potential scale formation within the production well (including scale formation on the second electric heater).

Further, as a necessary incident, by having the collected reservoir fluid 226 be free, or substantially free, of the heating fluid, production of a "drier" hydrocarbon material is facilitated. This reduces energy requirements to transport the produced fluid 224 to the surface 2006 (as there is less fluid volume to produce) and also reduces demands on separation processes for removal of heating fluid from the produced fluids.

In this respect, in some embodiments, for example, the rate of heating of the collected reservoir fluid by the second electric heater 220 is modulated such that the collected reservoir fluid 226 consists of, or substantially consists of, the mobilized hydrocarbon material, and, in this respect, is free, or substantially free, of the heating fluid.

In some embodiments, for example, the composition of the collected reservoir fluid 226 may be sensed by a densitometer. In this respect, the rate of heating effected by the electric heater 220 may be modulated based on sensing of the density of the collected reservoir fluid by the densitometer. In response to sensing of a density of the collected reservoir fluid that is characteristic of a collected reservoir fluid having excessive non-hydrocarbon fluid (such as the heating fluid), the rate of heating by the electric heater 220 may be increased to effect evaporation of the fluid. This will promote the maintenance of a collected reservoir fluid that consists of hydrocarbon material, or substantially hydrocarbon material, and, in this respect, is free, or substantially free, of the heating fluid. This promotes reflux of the condensed heating fluid (as above-described), higher quality heat transfer to effect the evaporation of the condensed heating fluid, mitigates scale formation, and production of "drier" hydrocarbon material.

In some embodiments, for example, the electric heater 220 is submerged within the collected reservoir fluid 226 (consisting of hydrocarbon material, or substantially hydrocarbon material, and, in this respect, being free, or substantially free, of the heating fluid), and the producing is modulated such that sufficient collected reservoir fluid is maintained within the production well 204 such that the electric heater is submerged within collected reservoir fluid.

In those embodiments where the temperature of the collected reservoir fluid 226, within the production well 204, is above the boiling point of the liquid heating fluid at the pressure of the hydrocarbon reservoir portion from which the mobilized hydrocarbon material is being produced, the collected reservoir fluid is produced, such that the produced collected reservoir fluid 224 is conducted to above the surface of the earth. In some embodiments, for example, the temperature of the collected reservoir fluid is between: (i) a temperature that is 10 degrees Celsius above the steam saturation temperature at the pressure within the hydrocarbon reservoir, and (ii) 350 degrees Celsius. In some embodiments, for example, the collected reservoir fluid 226 consists of, or substantially consists of, mobilized hydrocarbon material, and, in some embodiments, for example, is free, or substantially free, of the heating fluid. Once disposed above the surface of the earth (such as, for example, within the surface facilities), the collected reservoir fluid becomes disposed in indirect heat exchange communication with a heat transfer fluid such that heat is indirectly transferred to the heat transfer fluid. The transferring of heat to the heat transfer fluid is such that the heat transfer fluid is evaporated. The evaporated heat transfer fluid is communicated to a turbine such that rotation of the turbine is effected, such that electricity is generated.

In some embodiments, for example, the laterally extending section **204*a* of the production well 204 is disposed below that of the laterally extending section of the non-production well 202. In some of these embodiments, for example, the laterally extending section of the production well 204 is disposed in alignment, or substantially alignment, with the laterally extending section of the non-production well 202**.

In some embodiments, for example, the laterally, or substantially laterally, extending section **204*a* of the production well 204 is co-operatively configured with the electric heater 220 such that while the reservoir fluid is being conducted towards the well 204**, the laterally, or substantially laterally, extending section of the production well is disposed to receive and collect the reservoir fluid across (but not necessarily continuously across) a reservoir fluid-receiving of the laterally, or substantially laterally, extending section of the production well, and the length of the operative portion, measured along the axis of the reservoir fluid-receiving portion, is at least 1000 meters. Because significant heating fluid is not supplied from the surface, heat losses, associated with longer wells, is not concerning, as it is for SAGD operations. Also, because the volumetric flow of produced fluid is relatively less than for SAGD production, hydraulic pressure losses are also not a material factor for well design. In combination, this enables the use of longer wells in in-situ reflux operations to effect production of hydrocarbon material, although shorter wells (i.e. those less than 1000 meters) could also be used.

In some embodiments, for example, the vertically, or substantially vertically, extending section 204*b* of the production well 204 has a length, measured along the axis of the vertically, or substantially vertically, extending section, of at least 1000 meters, so as to allow production from deeper resources. Again, heat losses and hydraulic pressure losses, with in-situ reflux are not concerning, as it is for SAGD operations, and it is, possible to, therefore, use longer wells, although shorter wells (i.e. those less than 1000 meters in depth) could also be used.

In some embodiments, for example, where the hydrocarbon reservoir contains relatively less viscous hydrocarbon material that is targeted for production, the non-production and production wells 202, 204 may be spaced apart a relatively greater distance than SAGD well pairs, such as by a spacing distance that is greater than five (5) meters, such as ten (10) meters.

In some embodiments, for example, the heating fluid being electrically heated within the non-production well 202, in its liquid state, may include formation water that is resident within the hydrocarbon reservoir, or may include heating fluid (for example, water) that is injected into the hydrocarbon reservoir and supplied from above the surface, or may include both of the formation water and the injected heating fluid. In some embodiments, for example, the supplying of supplied liquid heating fluid 118 is effected via an injector string 216 disposed within the non-production well 202. In some embodiments, for example, the injector string includes a "spaghetti string". In those embodiments where at least a fraction of the liquid heating fluid is being supplied from above the surface, in some of these embodiments, for example, the ratio of the volumetric rate at which the supplied liquid heating fluid is being supplied to the rate at which heat energy is being delivered by the electric heater is less than 25 cubic meters per day per megawatt, such as, for example, less than 10 cubic meters per day per megawatt.

In some embodiments, for example, heating fluid may be lost to the reservoir, and make-up heating fluid may be required. In this respect, while the heating of a liquid heating fluid is being effected, supplemental liquid heating fluid may be supplied from a source disposed above the surface 2002, such as via the injection string 216. In this respect, the liquid heating fluid includes the supplemental liquid heating fluid. In some embodiments, for example, the supplying of the supplemental liquid heating fluid is effected in response to sensing of a pressure, within the hydrocarbon reservoir portion from which the mobilized hydrocarbon material is being produced, that is less than a predetermined pressure. The predetermined pressure is based on, amongst other things, the desirability of operating at higher pressures in order to provide a greater driving force for production, balanced versus the recognition that heat transfer efficiency is more efficient at lower pressures and that cap rock integrity may limit the maximum possible operating pressure. The injector string 216 may be disposed outside of the well, and could also be used to inject heating fluid during start-up.

In operation, during start-up, the hydrocarbon reservoir is heated by heat generated by the first and second electric heaters 206, 220 (either directly or via the heater assembly), such that hydrocarbon material is mobilized by the heating of the hydrocarbon reservoir. The mobilized hydrocarbon material drains and enters the non-production well 202 via ports 208. The heating is effected by conduction, convection, or a combination of conduction and convection. In some embodiments, for example, the convective heating is effected by evaporated formation water, such that the heating fluid includes evaporated formation water. Subsequently, or, in parallel, heating fluid is supplied from the surface facilities and is injected into the hydrocarbon reservoir. Evaporation of the injected heating fluid is effected by the heat generated by the electric heater 206. The evaporated heating fluid is conducted to the hydrocarbon reservoir and transfers heat energy to the hydrocarbon material such that the hydrocarbon material is mobilized and the heating fluid is condensed.

Reservoir fluid enters the non-production well 202 via ports 208, collects within the collection reservoir 210 and is heated by the first electric heater 206 (either directly or via the heater assembly). The heating is controlled such that the collected reservoir fluid is free, or substantially free, of heating fluid, and, in some embodiments, for example, consists of, or substantially consists of, the mobilized hydrocarbon material. The heated reservoir fluid transfers heat to condensed heating fluid that is disposed in heat transfer communication with the reservoir fluid, thereby effect re-evaporation of the condensed heating fluid, and thereby effect the reflux 214.

Reservoir fluid 226 also drains, by gravity, and enters the production well 204 through ports 222, and is collected within the collection reservoir defined within the production well 204, and is heated by the second electric heater. The heating is controlled such that the collected reservoir fluid is free, or substantially free, of heating fluid, and, in some embodiments, for example, consists of, or substantially consists of, the mobilized hydrocarbon material. The heated reservoir fluid transfers heat to any condensed heating fluid that is disposed in heat transfer communication with the reservoir fluid, thereby effect re-evaporation of the condensed heating fluid, and thereby effect the reflux 228, and also thereby providing a drier hydrocarbon material for production.

Eventually, after sufficient hydrocarbon material has been mobilized and drained into the non-production and production wells 202, 204 (such as, for example, as described above), an evaporated heating fluid chamber develops (where the heating fluid, in the liquid state, is water, then a steam chamber would be developed). The developed evaporated heating fluid chamber enables evaporated heating fluid to be conducted to hydrocarbon material within the hydrocarbon reservoir (and, more specifically, at the edge of the chamber) so as to heat, mobilize and then drive drainage of the hydrocarbon material towards the production well 204. In parallel, the drained hydrocarbon material may be produced from the production well 204 using reservoir pressure or with assistance of artificial lift, such as with a downhole pump or gas lift.

In some embodiments, for example, it may be desirable, after the hydrocarbon reservoir has been sufficiently heated in the region surrounding the production well 204, to reduce the rate at which heat is generated by the second electric heater, or suspend the generation of heat by the second electric heater, thereby reducing operating costs and also mitigating coking. In this respect, the process includes:

during a first time interval, effecting electrical heating of the hydrocarbon reservoir with both of the first and second electric heaters (in some embodiments, for example, liquid heating fluid is supplied through the non-production well 202 and is heating by the first electric heater, and, in some embodiments, for example, liquid heating fluid may also be supplied through the production well 204 and be heated by the second electric heater); and after the first time interval, and during a second time interval, while either one of:

(a) the second electrical heater is delivering heat energy at a rate that is less than 50% of the rate at which heat energy is being delivered by the second electrical heater during the first time interval, or (b) the electrical heating being effected by the second electrical heater has become suspended;

and while continuing to effect the electrical heating with the first electric heater:

(a) supplying a liquid heating fluid to the hydrocarbon reservoir through the non-production well 202, such that a combined heating fluid, including the supplied liquid heating fluid and a condensed heating fluid, is evaporated to produce a gaseous heating fluid that is conducted into the reservoir and then condensed upon heating of hydrocarbon material to produce the condensed heating fluid; and (b) producing, via the production well 204, reservoir fluid that has collected within the production well 204, wherein the collected reservoir fluid includes hydrocarbon material that has been mobilized by the electrical heating.

The electrical heating of the hydrocarbon reservoir during the first time interval, in combination with the electrical heating of the hydrocarbon reservoir during the second time interval by the first electric heater and any electrical heating of the hydrocarbon reservoir during the second time interval by the second electrical heater, is sufficient to, during the second time interval, effect evaporation of the condensed heating fluid, that has been condensed after having effected heating and mobilization of the hydrocarbon material, prior to the condensed heating fluid being received by the production well 204.

In some embodiments, for example, the electrical heating of the hydrocarbon reservoir during the first time interval, in combination with the electrical heating of the hydrocarbon reservoir during the second time interval by the first electric heater and any electrical heating of the hydrocarbon reservoir during the second time interval by the second electrical heater, is sufficient to, during the second time interval, effect evaporation of the condensed heating fluid, that has been condensed after having effected heating and mobilization of the hydrocarbon material, prior to the condensed heating fluid being received by the production well 204, such that the collected reservoir fluid consists of, or substantially consists of, the mobilized hydrocarbon material and, in this respect, is free, or substantially free, of heating fluid.

Reducing the rate at which heat energy is being delivered by the electrical heater to the reservoir fluid that has collected within the production well 204, after sufficient electrical heating of the hydrocarbon reservoir during the first time interval, mitigates coking while also enabling the production of reservoir fluid, collecting within the production well, that is free, or substantially free, of the heating fluid. In some embodiments, for example, the collected reservoir fluid consists of, or substantially consists of, hydrocarbon material. It is believed that, after sufficient time, continued heating, at the same rate, by the second electric heater becomes unnecessary to effect evaporation of the condensed heating fluid, that has been condensed after effecting heating and mobilization of the hydrocarbon material, prior to the condensed heating fluid being received by the production well 204, and that the rate at which such heat energy is being delivered can be reduced.

In some embodiments, for example, during the first time interval, supplying of a liquid heating fluid is also being effected via the non-production well 202, such that a combined heating fluid, including the supplied liquid heating fluid and a condensed heating fluid, is evaporated to produce a gaseous heating fluid that is conducted into the reservoir and then condensed upon heating of hydrocarbon material to produce the condensed heating fluid.

In some embodiments, for example, during the first time interval, the heat being generated by the first electric heater effects heating of the reservoir fluid that has collected within the non-production well such that the collected reservoir fluid is free, or substantially free, of heating fluid. In some embodiments, for example, the collected reservoir fluid consists of, or substantially consists of, hydrocarbon material that has been heated and mobilized by the gaseous heating fluid and drained to the non-production well. In this respect, the hydrocarbon material, that has been collected within the non-production well function as a heat transfer medium, transferring heat generated by the first electric heater to the condensed heating fluid disposed externally of the non-production well. As well, during the first time interval, reservoir fluid, including hydrocarbon material that has been heated and mobilized by the gaseous heating fluid, that has been collected within the production well 204, is produced via the production well 204. In some of these embodiments, for example, during the first time interval, the electrical heating by the second electrical heater is such that the temperature of the collected reservoir fluid is less than 350 degrees Celsius (such as, for example, less than 350 degrees Celsius, such as, for example, less than 250 degrees Celsius, such as, for example, less than 220 degrees Celsius), thereby mitigating coking within the production well 204 during the first time interval.

Figure 3:
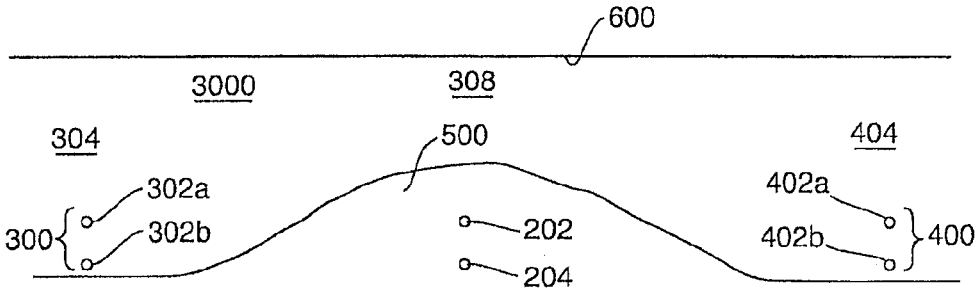
FIG. 3 is a schematic illustration of an embodiment of a system used to implement the in-situ reflux process within a wedge zone.

Referring to FIG. 3, in another aspect, there is provided a process for producing hydrocarbon material from an hydrocarbon reservoir using two adjacent SAGD well pairs 300, 400, wherein, after the SAGD well pairs 300, 400 have already been operating for a period of time, the in-situ reflux process is implemented within a residual or "wedge" zone 500, disposed between the SAGD well pairs, which has not been produced, or substantially produced, by the operation of the SAGD well pairs. The wedge zone 500 is a zone within the subterranean formation within which is disposed unrecovered oil that has not become disposed within the SAGD steam chambers.

In this respect, the process includes:

operating a first steam-assisted gravity drainage ("SAGD") system including the SAGD well pair 300, the SAGD well pair 300 including a first SAGD injection well 302*a* and a first SAGD production well 302*b*, such that hydrocarbon material is produced from the first SAGD production well 304*b;* operating a second SAGD system including the well pair 400, the well pair 400 including a second SAGD injection well 402*a* and a second SAGD production well 402*b*, such that hydrocarbon material is produced from the second SAGD production well 402*b*; and after respective hydrocarbon material production has been effected by each one of the operation of the first SAGD system and the operation of the second SAGD system, independently, operating an in-situ reflux process, wherein the operating an in-situ reflux process includes:

within the hydrocarbon reservoir 3000, electrically heating a liquid heating fluid such that the liquid first heating fluid is evaporated to produce a gaseous first heating fluid;

heating hydrocarbon material, within an intermediate hydrocarbon reservoir zone 500 disposed between the first and second SAGD well pairs 300, 400, with the gaseous heating fluid such that the heated hydrocarbon material is mobilized and such that the gaseous heating fluid is condensed to produce a condensed heating fluid; and electrically heating at least a fraction of the condensed heating fluid such that the at least a condensed heating fluid fraction is re-evaporated;

and while the evaporation, the condensing, and the re-evaporation is being effected, producing reservoir fluid, including at least a fraction of the mobilized hydrocarbon material, through the intermediate production well 204 disposed within the intermediate hydrocarbon reservoir zone 500.

In this context, while operating a SAGD system, the steam being supplied into the hydrocarbon reservoir may be co-injected with an additive, such as a solvent (that is soluble within bitumen), or a non-compressible gas.

Figure 4:
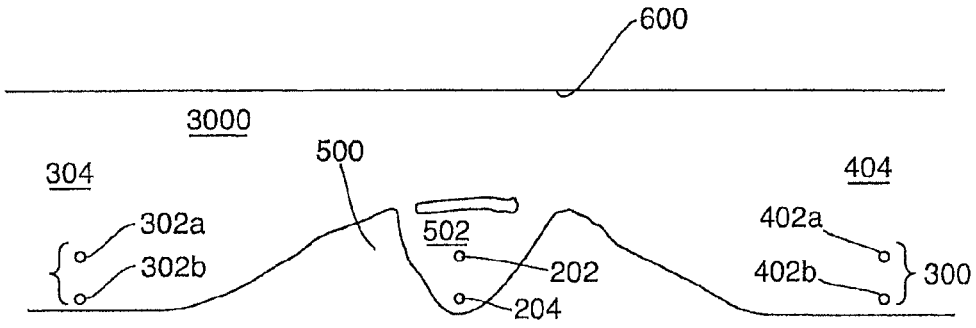
FIG. 4 is a schematic illustration of an embodiment of a system that is implementing the in-situ reflux process within a wedge zone after fluid communication has been established between the refluxing heating fluid in the wedge zone and the SAGD steam chambers.

In some embodiments, for example, the operating of the in-situ reflux process effects fluid communication between the intermediate production well 204 and the injection well 302*a* or 402*a* of at least one of the SAGD well pairs 300, 400 (see FIG. 4). In this respect, the operation of the in-situ reflux process effects creation of an evaporated heating fluid chamber 502 (where the heating fluid, in the liquid state, is water, then a steam chamber would be created) that eventually effects fluid communication between the injection well (302*a* and 402*a*) and the well 204 In this respect, in some embodiments, for example, after the fluid communication has been established between the intermediate production well and the injection well of at least one of the first and second SAGD well pairs, the process further includes shutting in the production well of the SAGD well pair having the injection well with which the intermediate production well has established fluid communication. In this respect, after such fluid communication has been established, the hydrocarbon material being mobilized via the SAGD operation could be produced by the intermediate production well. This may be particularly suitable when the drainage angles of a steam chamber of a more mature SAGD operation are relatively low, and draining of hydrocarbon material may be relatively faster through the fluid channels that have been established while operating the in-situ reflux process within the zone that is disposed between the adjacent SAGD well pairs.

In some embodiments, for example, wherein the operating of the in-situ reflux process is initiated after both of: (i) the operating of the first SAGD system and (ii) the operating of the second SAGD system have been suspended. In this respect, operations involving the first and second SAGD systems may be fairly mature, and production rates are fairly low to justify continued operation, resulting in the opportunity for in-situ reflux process to replace production.

In some embodiments, for example, the operating of a first SAGD system effects creation of a first SAGD steam chamber 304; and the operating of a second SAGD system effects creation of a second SAGD steam chamber 404; and the operating of the in-situ reflux process effects creation of an intermediate heating fluid chamber 502 within the intermediate hydrocarbon reservoir zone 500. The operating of the first and second SAGD systems is such that a residual zone, within the hydrocarbon reservoir, is defined between the first and second SAGD steam chambers, wherein the intermediate production well 204 is disposed within the residual (or "wedge") zone 500.

Referring again to FIG. 4, in some embodiments, for example, the operating of a first SAGD system, the operating of a second SAGD system, and the operating of the intermediate production well 204 co-operate such that fluid communication is established between the intermediate steam chamber 502 and at least one of the first and second SAGD steam chambers 304 or 404. After the fluid communication has been established between the intermediate steam chamber and at least one of the first and second SAGD steam chambers, the production well, of the SAGD well pair of the SAGD system whose operation has created the SAGD steam chamber with which the intermediate production well 204 has established fluid communication, may be shut-in, for the reasons that are above-described.

In some embodiments, for example, the operating of the in-situ reflux process is initiated after merger of the first and second SAGD steam chambers 304, 404 via interwell region 308.

Figure 5:
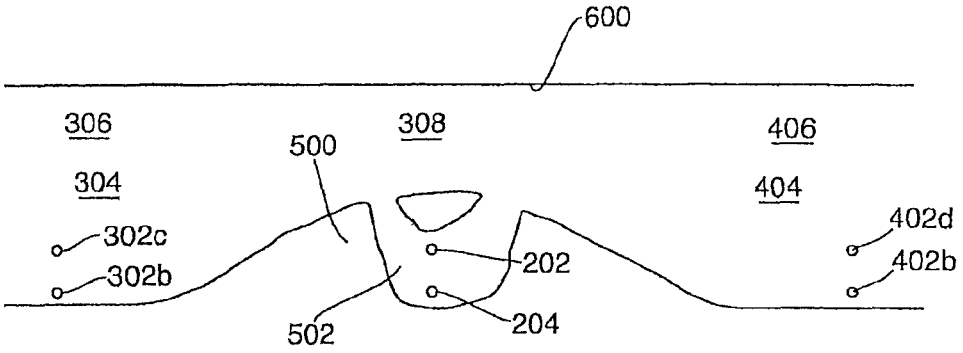
FIG. 5 is a schematic illustration of an embodiment of a system that is implementing the in-situ reflux process within a wedge zone, and an in-situ combustion process in a steam swept zone using existing SAGD injection wells for effecting supply of oxidant and effecting removal of combustion gases, after communication has been established between the refluxing heating fluid in the wedge zone and the SAGD steam chambers.
Figure 6:
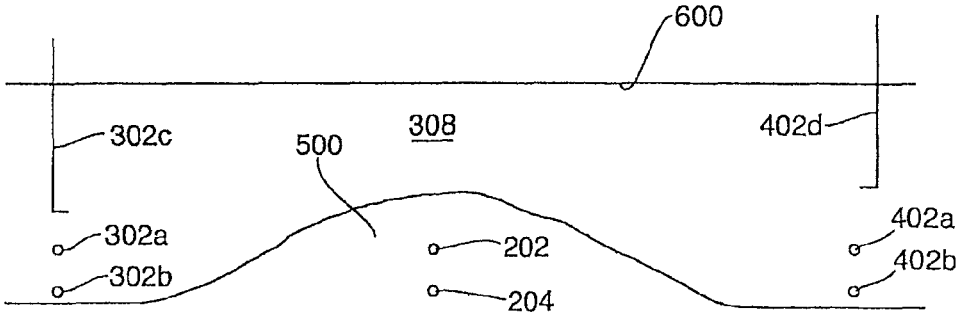
FIG. 6 is a schematic illustration of an embodiment of a system used to implement the in-situ reflux process within a wedge zone, and an in-situ combustion process in a steam swept zone using a separate oxidant injector and vent.

Referring to FIGS. 5 and 6, in some embodiments, the SAGD operations may be converted to incorporate both an in-situ reflux process and a hybrid steam/in-situ combustion process (a combustion process where steam is co-injected with the oxidant). The operation of a hybrid steam/in-situ combustion process, in combination with the in-situ reflux process, may improve production rates and promote more efficient recovery of hydrocarbon material.

In this respect, in some embodiments, for example, the first SAGD steam chamber 304 may be said to define a first steam swept zone 306, and the second SAGD steam chamber 404 may be said to define a second steam swept zone 406, and the process further comprises combusting a fraction of the residual hydrocarbon material within at least one of first and second steam swept zones. The combusting of the residual hydrocarbon material increases temperature conditions and produces steam within the reservoir, thereby enabling mobilization and recovery of other residual hydrocarbon material. In some embodiments, for example, the production well, of the SAGD well pair of the SAGD system whose operation has created the SAGD steam chamber which defines the associated steam swept zone within which the combusting is being effected, receives and produces the hydrocarbon material mobilized by the combusting.

In some embodiments, for example, each one of: (i) the operating of the intermediate production well 204 and (ii) the combusting of a fraction of the residual hydrocarbon material is initiated, independently, after merger of the first and second SAGD steam chambers 304, 404. Merger of the first and second steam chambers via the region 308 (typically, just below the cap rock 600), is a signal indicative of maturation of the SAGD operations, and may function as a trigger to rely on other enhanced oil recovery processes, such as in-situ reflux and in-situ combustion processes, to effect hydrocarbon material production.

In some embodiments, for example, the operating of a first SAGD system, the operating of a second SAGD system, and the operating of the intermediate production well 204 co-operate such that fluid communication is established between the intermediate steam chamber 502 and at least one of the first and second steam swept zones 306, 406, and the combusting of a fraction of the residual hydrocarbon material is being effected within such steam swept zone while the fluid communication between the intermediate production well and such steam swept zone has been established.

By virtue of such fluid communication, steam produced by the combustion may be conducted to the residual zone 500 within which the in-situ reflux process is being operated, and thereby provide make-up heating fluid to assist with production of hydrocarbon material within the residual zone. Also, operation of the in-situ reflux process creates additional steam swept zone-containing residual hydrocarbon material which may be available for recovery by the combustion process. As well, the in-situ reflux, in producing its own associated heating fluid chamber within the residual zone, produces a heating fluid chamber 502 with relatively steeper drainage angles than those within the steam swept zones 306, 406 where the combustion is occurring, thereby providing a more efficient route to receive and produce hydrocarbon material that is mobilized by the combustion.

In some embodiments, for example, the combusting of a fraction of the residual hydrocarbon material is initiated within such steam swept zone 306 or 406 only after the fluid communication between the intermediate production well 204 and such steam swept zone 306 or 406 has been established.

In some embodiments, for example, each one of: (i) the operating of the in-situ reflux process and (ii) the combusting of a fraction of the residual hydrocarbon material is initiated, independently, after reducing the rate of injection of steam through the injection well 302*a* or 402*a* of, with respect to each one of the at least one steam swept zone within which the residual hydrocarbon material is combusted, the SAGD well pair 300 or 400 of the SAGD system that has been operated to create the SAGD steam chamber 304*a* or 304*b* which defines the steam swept zone 306*a* or 306*b*. In some embodiments, for example, the reducing of the rate of injection of steam is such that the injection of steam becomes suspended.

Referring to FIG. 5, in some embodiments, for example, the injection well 302*a* or 402*a* of one of the SAGD well pairs 300, 400 be converted to effect delivery of oxidant to a steam swept zone for effecting combustion within the steam swept zone. In this respect, in some embodiments, for example, the process further includes reducing the rate of injection of steam through the injection well (in the illustrated embodiment, this would be the well 302*a*) of at least one of the SAGD well pairs, converting the well 302*a* such that the well includes an oxidant injection well 302*c*, and supplying oxidant to the steam swept zone via the oxidant injection well. The combusting of a fraction of the residual hydrocarbon material can be effected by the supplied oxidant. A separate fluid conductor could be inserted to the injection well for functioning as an injector to ensure that the oxidant is supplied to the steam swept zone at a sufficient rate in order to effect high temperature oxidation. Correspondingly, the injection well (in the illustrated embodiment, this would be the well 402*a*) of the other one of the adjacent SAGD well pairs can be converted to a vent gas removal well 402*d* to remove combustion gases from the reservoir.

Alternatively, and referring to FIG. 6, separate injection wells 302*c* could be created to supply the oxidant to the steam swept zones, and a separate vent gas removal well 402*d* could be created to remove combustion gases from the reservoir.

The oxidant may be co-injected with other gaseous material, such as steam, through the oxidant injection well 302*c*.

Figure 7:
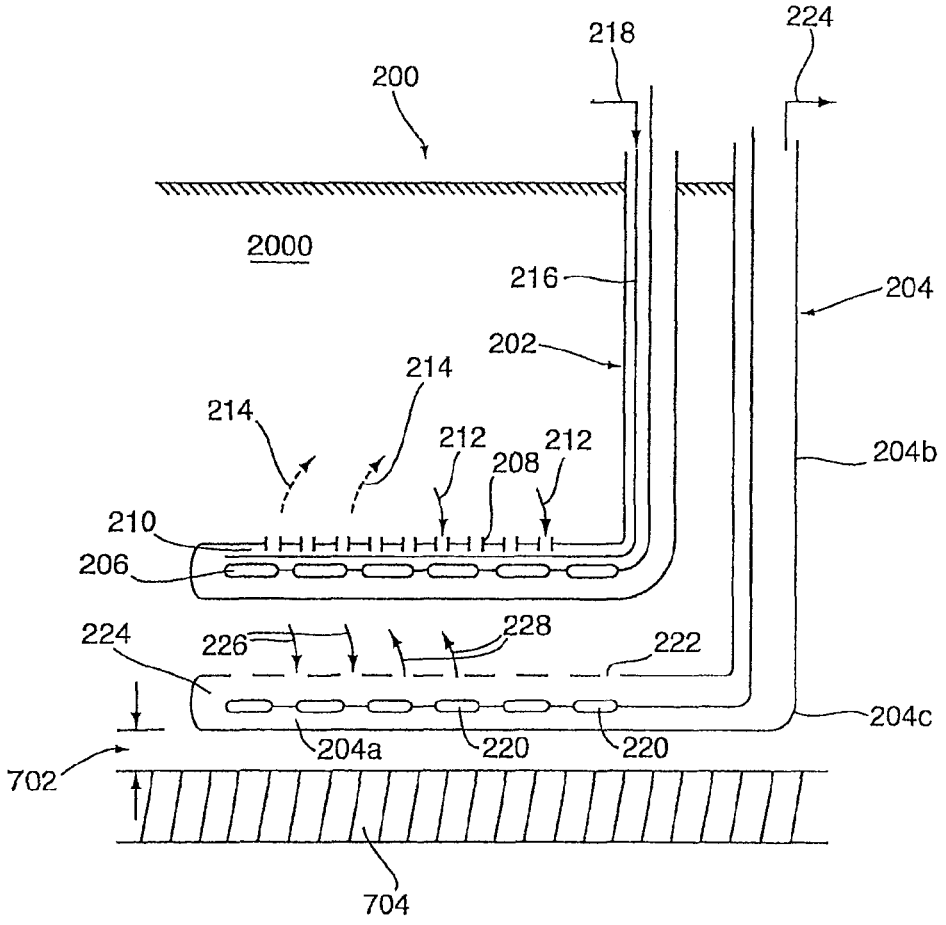
FIG. 7 is a schematic illustration of an embodiment of a system used to implement the in-situ reflux process within a hydrocarbon reservoir having an active water zone.

Referring to FIG. 7, in a further aspect, the in-situ reflux process may be implemented within a hydrocarbon reservoir having an active water zone 704. As used herein, the term "active water zone" is defined as a zone within the hydrocarbon reservoir that includes water that, at the native-state reservoir conditions (such as before any recovery process starts) can move in response to a driving force, such as a pressure differential, and is characterized by a recharge rate of greater than or equal to 10 cubic meters per day. In some embodiments, for example, the active water zone is a bottom water zone. The bottom water zone is an active water zone that is underlying a liquid hydrocarbon-containing zone of the hydrocarbon reservoir. In some embodiments, for example, the in-situ reflux process is implemented within a heavy oil-containing reservoir having an active water zone, including such a reservoir that has been previously produced via "CHOPS" (cold heavy oil production with sand).

The presence of active water zones within hydrocarbon reservoirs interfere with production of hydrocarbon material from a pay zone, when using some thermal enhanced oil recovery processes. For example, with SAGD, steam may be lost to the active water zone due to a hydraulic pressure gradient between the steam chamber and the active water zone, or fluid, from the active water zone, may invade the steam chamber, again due to a hydraulic pressure gradient. Such fluid incursion within the steam chamber may disrupt the SAGD process. To mitigate steam losses or fluid incursion from the active water zones, it has been suggested to reduce or eliminate pressure gradients between the SAGD steam chamber and the active water zone. However, pressure matching is difficult with SAGD, due to the difficulty in realizing steam conformance. Additionally, it has been suggested to operate SAGD at a higher pressure than the active water zone, with the premise that it is better to lose steam to the active water zone than to allow fluid incursion from the active water zone. However, this may result in significant stand-off distances, resulting in potentially significant quantities of sterilized hydrocarbon material beneath the stand-off plane.

Some of these problems are obviated when practising the in-situ reflux process in reservoirs containing active water zones.

Because hydraulic pressure drop within a production well 204 of an in-situ reflux process is not relatively significant (in comparison, for example, to that within a SAGD production well), pressure matching between the in-situ reflux process and the active water zone is more likely to be approached or realized.

Also, when using an electric heater 220 that includes a plurality of heater segments, each one of them being controllable independently from the others, heating fluid conformance is more likely approached or realized, which thereby mitigates the need to provide for large stand-off distances 702 to account for well placement deviations. In this respect, the minimum standoff distance 702 between a laterally, or substantially laterally, extending section of the production well 204, through which the produced fluid is being produced, and the active water zone is less than two (2) meters. In some embodiments, for example, the minimum stand-off distance is less than one (1) meter.

In FIGS. 4 to 7, the production well 204 is shown in association with a non-production well 202, similar to the system 200 illustrated in FIG. 2, for implementing the in-situ reflux process. It is understood that the single-well design of the system 200 illustrated in FIG. 1, which includes the production well 102, could also be used to implement the in-situ reflux process in the context of the embodiments illustrated in FIGS. 4 to 7. It is understood the production wells 102, 204 and the non-production well 202 could be infill wells.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

What is claimed is:

1. A process for producing hydrocarbon-comprising material from a hydrocarbon reservoir comprising:

(a) during a first time interval, while supplying a liquid heating fluid to the hydrocarbon reservoir through a well, electrically heating, within the well, with an electrical heater, a combined heating fluid including the supplied liquid heating fluid and a condensed heating fluid, such that the combined heating fluid is evaporated to produce a gaseous heating fluid that is conducted into the reservoir and then condensed upon heating of hydrocarbon material to produce the condensed heating fluid;

(b) suspending the supplying of the liquid heating fluid;

(c) after the suspending of the supplying of the liquid heating fluid, and during a second time interval, reducing the rate at which heat energy is being delivered by the electric heater such that the rate at which heat energy is being delivered by the electric heater is less than 50% of the rate at which heat energy is being delivered by the electric heater during the first time interval, and while the electric heater is delivering the heat energy at the reduced rate, collecting reservoir fluid within the well, and producing the collected reservoir fluid, wherein the collected reservoir fluid includes the heated hydrocarbon material that has become mobilized and drained into the well;

(d) suspending the producing; and wherein the steps (a) to (d) are repeated at least once.

2. The process as claimed in claim 1;

wherein the electrical heating of the hydrocarbon reservoir during the first time interval, in combination with any electrical heating of the hydrocarbon reservoir during the second time interval, is sufficient to, during the second time interval, effect evaporation of condensed heating fluid, that has condensed after effecting heating and mobilization of the hydrocarbon material, wherein the evaporation of the condensed heating fluid is effected prior to the condensed heating fluid being received by the well.

3. The process as claimed in claim 1;

wherein the electrical heating of the hydrocarbon reservoir during the first time interval, in combination with any electrical heating of the hydrocarbon reservoir during the second time interval, is sufficient to, during the second time interval, effect evaporation of condensed heating fluid, that has condensed after effecting heating and mobilization of the hydrocarbon material, wherein the evaporation of the condensed heating fluid is effected prior to the condensed heating fluid being received by the well, such that the collected reservoir fluid is free of heating fluid.

4. The process as claimed in claim 1;

wherein the collected reservoir fluid comprises the mobilized hydrocarbon material.

5. The process as claimed in claim 1;

wherein the reducing the rate at which heat energy is being delivered by the electric heater is such that the electrical heating is suspended.

6. The process as claimed in claim 1;

wherein the electrical heating of the hydrocarbon reservoir during the first time interval, in combination with any electrical heating of the hydrocarbon reservoir during the second time interval is with effect that the temperature of the collected reservoir fluid is less than 350 degrees Celsius.

7. A process for producing hydrocarbon-comprising material from a hydrocarbon reservoir comprising:

(a) during a first time interval, while supplying a liquid heating fluid to the hydrocarbon reservoir through a well, electrically heating, within the well, a combined heating fluid including the supplied liquid heating fluid and a condensed heating fluid, such that the combined heating fluid is evaporated to produce a gaseous heating fluid that is conducted into the reservoir, and then condensed upon heating of hydrocarbon material to produce the condensed heating fluid;

(b) suspending the supplying of the liquid heating fluid;

(c) after the suspending of the supplying of the liquid heating fluid, during a second time interval, modulating the electrical heating such that the electrical heating of reservoir fluid that is being collected within the well is such that the temperature of the collected reservoir fluid is less than 350 degrees Celsius, and, while the modulated electrical heating of collected reservoir fluid is being effected, producing the collected reservoir fluid from the well;

(d) suspending the producing; and wherein the steps (a) to (d) are repeated at least once.

8. The process as claimed in claim 7;

wherein the electrical heating of the hydrocarbon reservoir during the first time interval, in combination with any electrical heating of the hydrocarbon reservoir during the second time interval, is sufficient to, during the second time interval, to effect evaporation of condensed heating fluid, that has condensed after effecting heating and mobilization of the hydrocarbon material, prior to the condensed heating fluid being received by the well.

9. The process as claimed in claim 7;

wherein the electrical heating of the hydrocarbon reservoir during the first time interval, in combination with any electrical heating of the hydrocarbon reservoir during the second time interval, is sufficient to, during the second time interval, effect evaporation of condensed heating fluid, that has condensed after effecting heating and mobilization of the hydrocarbon material, prior to the condensed heating fluid being received by the well, such that the collected reservoir fluid is free of the heating fluid.

10. The process as claimed in claim 7;

wherein the collected reservoir fluid consists of comprises the mobilized hydrocarbon material.

11. The process as claimed in claim 7;

wherein the modulating of the electrical heating includes suspending of the electrical heating.

12. A process for producing hydrocarbon-comprising material from a hydrocarbon reservoir comprising:

during a first time interval:

while supplying a liquid heating fluid to the hydrocarbon reservoir through a non-production well that is disposed within the hydrocarbon reservoir, electrically heating, within the non-production well, with a first electrical heater, a combined heating fluid including the supplied liquid heating fluid and a condensed heating fluid, such that the combined heating fluid is evaporated to produce a gaseous heating fluid that is conducted into the reservoir and then condensed upon heating of hydrocarbon material to produce the condensed heating fluid; and with a second electrical heater disposed within a production well that is disposed below the non-production well and within the hydrocarbon reservoir, electrically heating the hydrocarbon reservoir;

and after the first time interval, and during a second time interval, while either one of:

(a) the second electrical heater is delivering heat energy at a rate that is less than 50% of the rate at which heat energy is being delivered by the second electrical heater during the first time interval; or (b) the electrical heating being effected by the second electrical heater has become suspended:

and while continuing to effect the electrical heating with the first electric heater:

supplying a liquid heating fluid to the hydrocarbon reservoir through the non-production well, such that a combined heating fluid, including the supplied liquid heating fluid and a condensed heating fluid, is evaporated to produce a gaseous heating fluid that is conducted into the hydrocarbon reservoir and then condensed upon heating of hydrocarbon material to produce the condensed heating fluid; and producing, via a production well, reservoir fluid that has collected within the production well, wherein the collected reservoir fluid includes hydrocarbon material that has been mobilized by the gaseous heating fluid.

13. The process as claimed in claim 12;

wherein the electrical heating of the hydrocarbon reservoir during the first time interval, in combination with the electrical heating of the hydrocarbon reservoir during the second time interval by the first electrical heater and any electrical heating of the hydrocarbon reservoir during the second time interval by the second electrical heater, is sufficient to, during the second time interval, effect evaporation of the condensed heating fluid, that has been condensed after having effected heating and mobilization of the hydrocarbon material, prior to the condensed heating fluid being received by the production well.

14. The process as claimed in claim 12;

wherein the electrical heating of the hydrocarbon reservoir during the first time interval, in combination with the electrical heating of the hydrocarbon reservoir during the second time interval by the first electrical heater and any electrical heating of the hydrocarbon reservoir during the second time interval by the second electrical heater, is sufficient to, during the second time interval, effect evaporation of the condensed heating fluid, that has been condensed after having effected heating and mobilization of the hydrocarbon material, prior to the condensed heating fluid being received by the production well, such that the collected reservoir fluid, that has collected within the production well, is free of the heating fluid.

15. The process as claimed in claim 12;

wherein, during the first time interval, a combined heating fluid, including the supplied liquid heating fluid and a condensed heating fluid, is evaporated to produce a gaseous heating fluid that is conducted into the reservoir and then condensed upon heating of hydrocarbon material to produce the condensed heating fluid.

16. The process as claimed in claim 12, further comprising, during the first time interval:

collecting reservoir fluid within the production well such that the collected reservoir fluid functions as a heat transfer medium, transferring heat generated by the first electric heater to the condensed heating fluid disposed externally of the production well; and producing reservoir fluid, including hydrocarbon material that has been heated and mobilized by the gaseous heating fluid, that has collected within the production well, via the production well, wherein the electrical heating of the collected reservoir fluid by the second electrical heater is such that the temperature of the collected reservoir fluid is less than 350 degrees Celsius.

17. The process as claimed in claim 12;

wherein, during the first interval, production of reservoir fluid from the production well is non-existent.

* * * * *